US011396184B2

(12) United States Patent
Nakano et al.

(10) Patent No.: US 11,396,184 B2
(45) Date of Patent: Jul. 26, 2022

(54) INK JET RECORDING APPARATUS

(71) Applicant: KYOCERA Document Solutions Inc., Osaka (JP)

(72) Inventors: Issei Nakano, Osaka (JP); Takashi Somete, Osaka (JP); Chikara Ishihara, Osaka (JP); Hiroyuki Ueda, Osaka (JP); Hiroomi Nakatsuji, Osaka (JP); Noriaki Furukawa, Osaka (JP); Aiichiro Otana, Osaka (JP); Jun Nakano, Osaka (JP); Yasutaka Inui, Osaka (JP); Takuma Araki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 83 days.

(21) Appl. No.: 16/887,326

(22) Filed: May 29, 2020

(65) Prior Publication Data

US 2020/0376834 A1 Dec. 3, 2020

(30) Foreign Application Priority Data

May 30, 2019 (JP) ..... JP2019-101518

(51) Int. Cl.
*B41J 2/165* (2006.01)
*B41J 2/045* (2006.01)

(52) U.S. Cl.
CPC ..... *B41J 2/16552* (2013.01); *B41J 2/16538* (2013.01); *B41J 2/16544* (2013.01); (Continued)

(58) Field of Classification Search
CPC ..... B41J 2/16552; B41J 2/16538; B41J 2/16544; B41J 2/16585; B41J 2/04563; (Continued)

(56) References Cited

U.S. PATENT DOCUMENTS 10,207,507 B2 * 2/2019 Furukawa ..... B41J 2/16552
2018/0154640 A1 6/2018 Furukawa et al.
(Continued)

FOREIGN PATENT DOCUMENTS

JP 2018-089829 A 6/2018
JP 2018-094722 A 6/2018

OTHER PUBLICATIONS

Extended European Search Report dated Oct. 26, 2020 mailed in the corresponding European Patent Application No. 20176786.0.

*Primary Examiner* — Geoffrey S Mruk
(74) *Attorney, Agent, or Firm* — IP Business Solutions, LLC

(57) ABSTRACT

An ink jet recording apparatus includes a recording head, a wiper member, a cleaning liquid supply device, and a controller. The recording head includes an ink ejection surface having an ink ejection port from which ink is ejected. The cleaning liquid supply device includes a cleaning liquid supply surface having a cleaning liquid supply port from which cleaning liquid for wiping the ink ejection surface with the wiper member is supplied, and is located upstream of the ink ejection surface in a wiping direction. The controller controls a cleaning operation including squeezing out the cleaning liquid containing bubbles from the cleaning liquid supply port, and moving the wiper member carrying the cleaning liquid containing bubbles, in the wiping direction from a movement start position to an end position ahead of the ink ejection surface.

9 Claims, 15 Drawing Sheets

(52) U.S. Cl.
CPC ..... *B41J 2/16585* (2013.01); *B41J 2/04563* (2013.01); *B41J 2002/16502* (2013.01); *B41J 2002/16558* (2013.01); *B41J 2002/16591* (2013.01)

(58) Field of Classification Search
CPC .... B41J 2002/16502; B41J 2002/16558; B41J 2002/16591
See application file for complete search history.

(56) References Cited

U.S. PATENT DOCUMENTS

| | | | | |
|---|---|---|---|---|
| 2018/0304635 | A1 | 10/2018 | Mu et al. | |
| 2019/0039312 | A1* | 2/2019 | Ge | B41J 2/16552 |
| 2019/0092024 | A1 | 3/2019 | Maeshima et al. | |
| 2019/0111686 | A1 | 4/2019 | Honda | |

* cited by examiner

| CLEANING LIQUID IN TANK | DEGASIFICATION INFORMATION IN STORAGE DEVICE |
|---|---|
| UNDEGASSED CLEANING LIQUID | UNDEGASSED |
| DEGASSED CLEANING LIQUID | DEGASSED |

INK JET RECORDING APPARATUS

INCORPORATION BY REFERENCE

This application claims priority to Japanese Patent Application No. 2019-101518 filed on May 30, 2019, the entire contents of which are incorporated by reference herein.

BACKGROUND

The present disclosure relates to an ink jet recording apparatus, and in particular to a technique to clean an ink ejection surface of a recording head.

Ink jet recording apparatuses are known that eject ink from a nozzle of a recording head, onto a recording medium such as a recording sheet. The ink droplet ejected from the nozzle of the recording head is separated into a main portion and minute droplets, in other words mist. The mist is highly susceptible to air resistance and carrier wind, and is therefore prone to stick to the nozzle surface of the recording head. When water-based ink is used, the mist gradually dries, thereby firmly adhering to the nozzle surface. In such a case, it is difficult to completely remove the mist by an ordinary cleaning method, such as purging the ink from the nozzle and wiping the nozzle surface several times with a rubber wiper.

Accordingly, an ink jet recording apparatus has been developed that includes a cleaning liquid supply device, having a cleaning liquid supply surface with a cleaning liquid supply port from which a cleaning liquid is supplied, and located upstream of the nozzle surface of the recording head in the wiping direction of the wiper. In this case, after the ink is purged from the nozzle, the nozzle surface is wiped by the wiper to which the cleaning liquid from the cleaning liquid supply port is applied. Such a mechanism for wiping the nozzle surface, with the wiper to which the cleaning liquid is applied, is useful for removing the mist stuck to nozzle surface.

SUMMARY

The disclosure proposes further improvement of the foregoing technique.

In an aspect, the disclosure provides an ink jet recording apparatus including a recording head, a wiper member, a cleaning liquid supply device, a cleaning liquid flow path, a driving device, and a control device. The recording head includes an ink ejection surface having an ejection port from which ink is ejected. The wiper member wipes the ink ejection surface, by moving in a predetermined wiping direction in contact with the ink ejection surface. The cleaning liquid supply device includes a cleaning liquid supply surface having a cleaning liquid supply port from which cleaning liquid for wiping the ink ejection surface with the wiper member is supplied, and is located upstream of the ink ejection surface in the wiping direction. The cleaning liquid flow path guides the cleaning liquid containing bubbles to the cleaning liquid supply device. The driving device provides force to move the cleaning liquid through the cleaning liquid flow path and squeeze out the cleaning liquid from the cleaning liquid supply port. The control device includes a processor, and acts as a controller when the processor executes a control program. The controller controls a cleaning operation performed by the wiper member to wipe the ink ejection surface with the cleaning liquid, the control of the cleaning operation including squeezing out the cleaning liquid containing bubbles from the cleaning liquid supply port, and moving the wiper member carrying the cleaning liquid containing bubbles, in the wiping direction from a movement start position to an end position ahead of the ink ejection surface.

DETAILED DESCRIPTION

Figure 1:
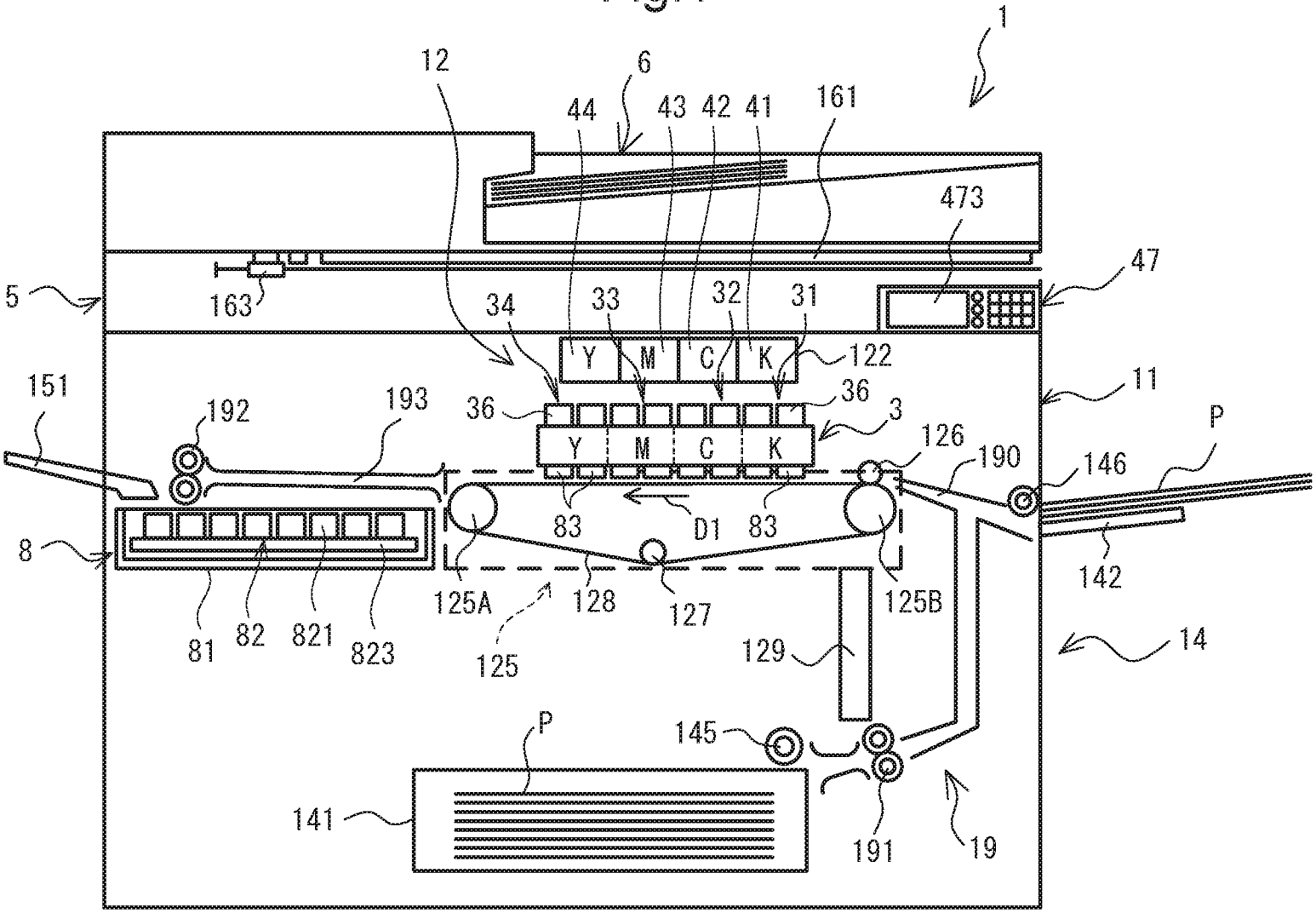
FIG. 1 is a front cross-sectional view showing a configuration of an ink jet recording apparatus according to a first embodiment of the disclosure.
Figure 2:
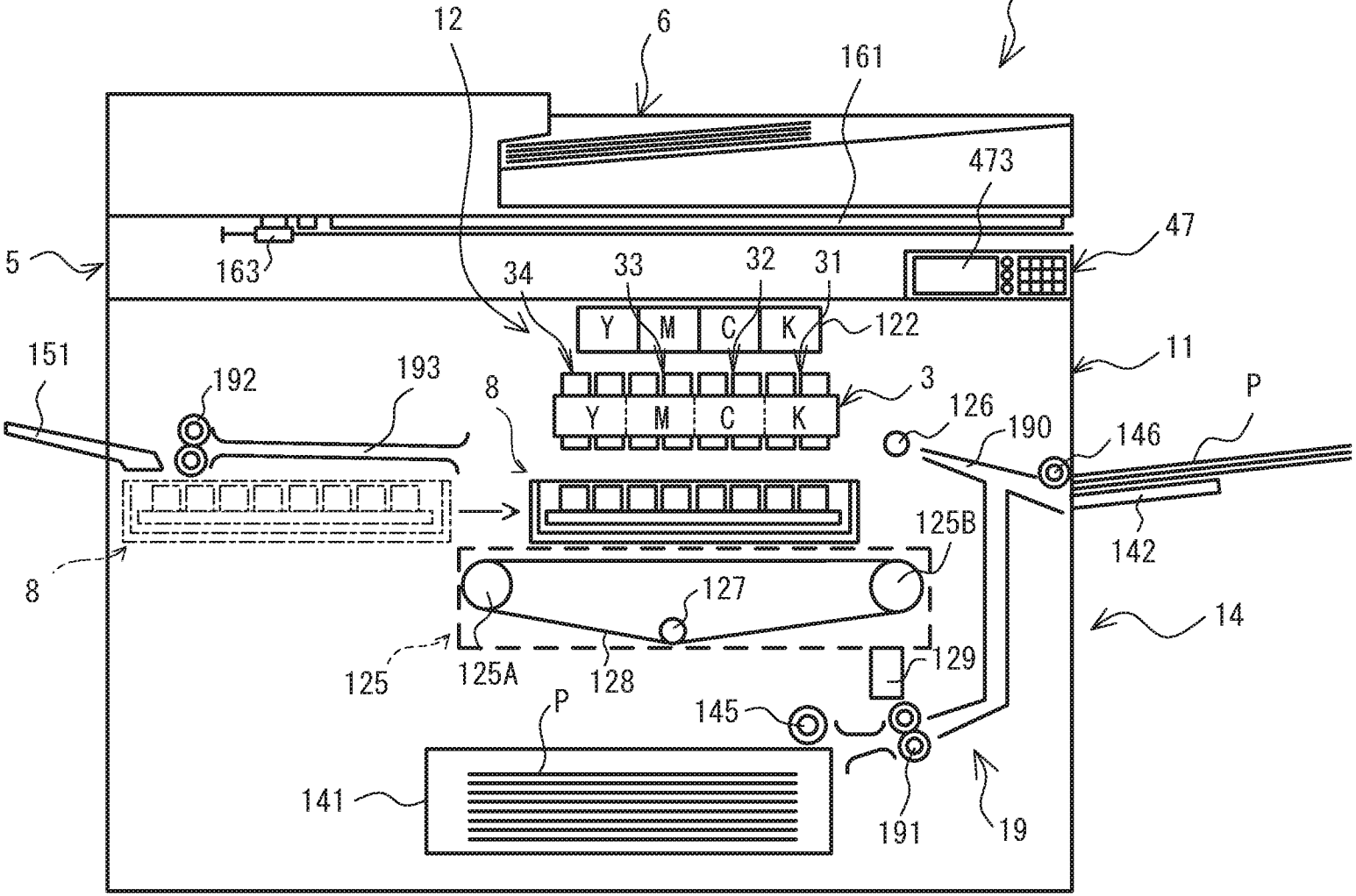
FIG. 2 is a front cross-sectional view showing a state where a conveying device has been moved to a lower maintenance position, and a cleaning device has been moved to a position right under a recorder.

Hereafter, an ink jet recording apparatus according to a first embodiment of the disclosure will be described, with reference to the drawings. FIG. 1 is a front cross-sectional view showing a configuration of the ink jet recording apparatus according to the first embodiment of the disclosure. FIG. 2 is a front cross-sectional view showing a state where a conveying device has been moved to a lower maintenance position, and a cleaning device has been moved to a position right under a recorder. The ink jet recording apparatus 1 is a multifunction peripheral having a plurality of functions, such as copying, printing, scanning, and facsimile transmission, and includes an operation device 47, a document feeding device 6, a document reading device 5, an image recording device 12, a paper feeding device 14, a paper conveyance device 19, a conveying device 125, and a cleaning device 8, which are provided on or inside a main body 11.

The operation device 47 is for receiving instructions from the user to execute the functions and operations that the ink jet recording apparatus 1 is configured to perform, for example an image recording operation. The operation device 47 includes a display device 473 for displaying, for example, an operation guide for the user. The display device 473 is set up as a touch panel, so that the user can operate the ink jet recording apparatus 1 by touching buttons and keys displayed on the screen.

To perform the document reading operation, the ink jet recording apparatus 1 operates as follows. The document reading device 5 optically reads the image on a source document delivered from the document feeding device 6 or placed on a platen glass 161, and generates image data. The image data generated by the document reading device 5 is stored, for example, in a non-illustrated image memory.

The document reading device 5 includes a reading mechanism 163 having a light emitter and a charge coupled device (CDC) sensor, to illuminate a source document with the light emitter having a light source, and receive the reflected light with the CCD sensor, thereby reading the image from the source document.

To perform the image forming operation, the ink jet recording apparatus 1 operates as follows. The image recording device 12 forms an image on a recording sheet P, delivered from the paper feeding device 14 and transported by the paper conveyance device 19, on the basis of the image data generated through the document reading operation, stored in the image memory, or received from a computer connected via a network.

The paper feeding device 14 includes a paper cassette 141. A feed roller 145 is provided on the upper side of the paper cassette 141, to feed the recording sheet P stored in the paper cassette 141 toward a transport route 190.

The paper feeding device 14 also includes a manual bypass tray 142, attached to a wall face of the main body 11 so as to be opened and closed. The recording sheet P set on the manual bypass tray 142 is delivered to the transport route 190 by a feed roller 146.

The paper conveyance device 19 includes the transport route 190 through which the recording sheet P is transported from the paper feeding device 14 to an output tray 151, a transport roller pair 191 located at a predetermined position on the transport route 190, and a discharge roller pair 192.

The recording sheet P delivered from the paper feeding device 14 is introduced into the transport route 190 by the transport roller pair 191. The recording sheet P, on which an image has been formed by the image recording device 12, is transported along an outgoing transport route 193 (part of the transport route 190) in a face-up orientation, and then discharged to the output tray 151 by the discharge roller pair 192.

The paper conveyance device 19 also includes a non-illustrated offset mechanism, configured to displace the discharge roller pair 192 in a right angle direction with respect to the recording sheet transport direction, to shift the recording sheet P to be discharged to the output tray 151 in the width direction of the recording sheet.

The image recording device 12, configured to record the image based on the document image data, on the recording sheet P delivered from the paper feeding device 14 and transported along the transport route 190, includes a conveying device 125, an adsorption roller 126, a recorder 3, and an ink tank 122.

The conveying device 125 includes a drive roller 125A, a follower roller 125B, a tension roller 127, and a conveyor belt 128. The conveyor belt 128 is an endless belt, wound over the drive roller 125A, the follower roller 125B, and the tension roller 127. The drive roller 125A is driven to rotate counterclockwise by a non-illustrated motor, so that, when the drive roller 125A is driven, the conveyor belt 128 runs counterclockwise, and the follower roller 125B and the tension roller 127 are made to also rotate counterclockwise.

The tension roller 127 serves to maintain the tension of the conveyor belt 128 at an appropriate level. The adsorption roller 126 is opposed, in contact with the conveyor belt 128, to the follower roller 125B, and charges the conveyor belt 128 so as to electrostatically adsorb the recording sheet P, delivered from the paper feeding device 14, to the conveyor belt 128.

The recorder 3 ejects ink droplets of four different colors (black, cyan, magenta, and yellow) onto the recording sheet P being transported by the paper conveyance device 19, thereby sequentially recording an image. In the ink tank 122, ink of the corresponding color is loaded.

To be more detailed, the recorder 3 includes line heads 31, 32, 33, and 34, respectively corresponding to black, cyan, magenta, and yellow. Thus, the ink jet recording apparatus 1 is a line-head ink jet recording apparatus. The recorder 3 also includes a head frame 35 (see FIG. 4A and FIG. 4B) supporting the line heads 31 to 34. The head frame 35 is supported by the main body 11.

The conveying device 125 is supported by an elevation mechanism 129 from below, and moved up and downward with respect to the line heads 31 to 34. In other words, the elevation mechanism 129 relatively moves the conveying device 125 with respect to the line heads 31 to 34, so as to locate the conveying device 125 close to and away from the line heads 31 to 34. More specifically, the elevation mechanism 129 moves the conveying device 125 between a recording position that enables the recorder 3 to execute printing (position shown in FIG. 1), and a maintenance position displaced downward from the recording position by a predetermined distance (position shown in FIG. 2).

Figure 3:
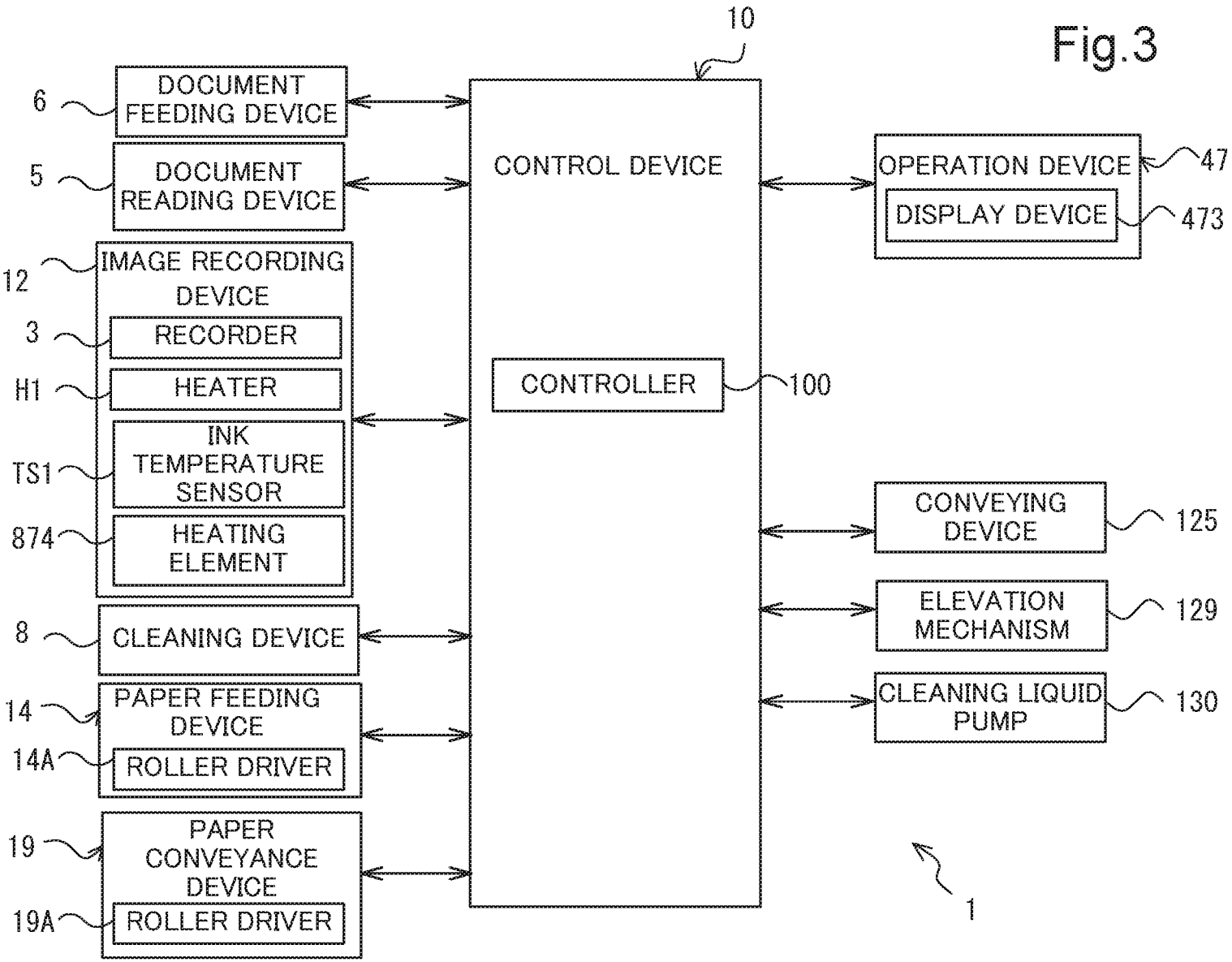
FIG. 3 is a functional block diagram showing an essential internal configuration of the ink jet recording apparatus according to the first embodiment.

FIG. 3 is a functional block diagram showing an essential internal configuration of the ink jet recording apparatus according to the first embodiment. The ink jet recording apparatus 1 includes the control device 10, the document feeding device 6, the document reading device 5, the image recording device 12, the paper feeding device 14, the paper conveyance device 19, the operation device 47, the conveying device 125, the elevation mechanism 129, a cleaning liquid pump 130, and the cleaning device 8. The same components as those of the ink jet recording apparatus 1 illustrated in FIG. 1 are denoted by the same reference numerals, and detailed description thereof will be omitted.

The paper feeding device 14 and the paper conveyance device 19 respectively include roller drivers 14A and 19A. The roller drivers 14A and 19A each include a motor, gears, and a driver. The roller driver 14A serves as an energy source that gives rotative force to the feed rollers 145 and 146. The roller driver 19A serves as an energy source that gives rotative force to the respective drive rollers of the transport roller pair 191 and the discharge roller pair 192.

The control device 10 includes a processor, a random-access memory (RAM), a read-only memory (ROM), and an exclusive hardware circuit. The processor is, for example, a central processing device (CPU), an application specific integrated circuit (ASIC), or a micro processing device (MPU). The control device 10 includes a controller 100.

The control device 10 acts as the controller 100, when the processor operates according to a control program stored in a built-in non-volatile memory. Here, the controller 100 may be constituted in the form of a hardware circuit, instead of being realized by the operation of the control device 10 according to the control program. This also applies to other embodiments, unless otherwise specifically noted.

The controller 100 controls the overall operation of the ink jet recording apparatus 1. The controller 100 is connected to the document feeding device 6, the document reading device 5, the image recording device 12, the paper feeding device 14, the paper conveyance device 19, the cleaning device 8, the operation device 47, the conveying device 125, the elevation mechanism 129, the cleaning liquid pump 130, and the heating element 874, to control the operation of the mentioned components.

The controller 100 controls, as will be subsequently described, a cleaning operation including causing a wiper member 821 to wipe an ink ejection surface 361 with cleaning liquid 831 containing bubbles.

Figure 4A:
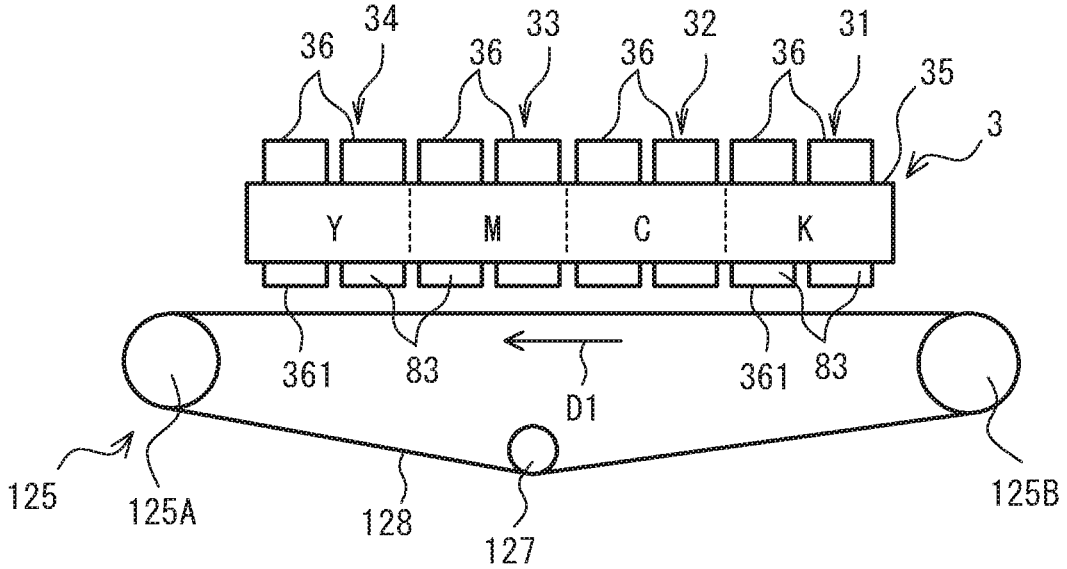
FIG. 4A is a schematic front view of the recorder and the conveying device.
Figure 4B:
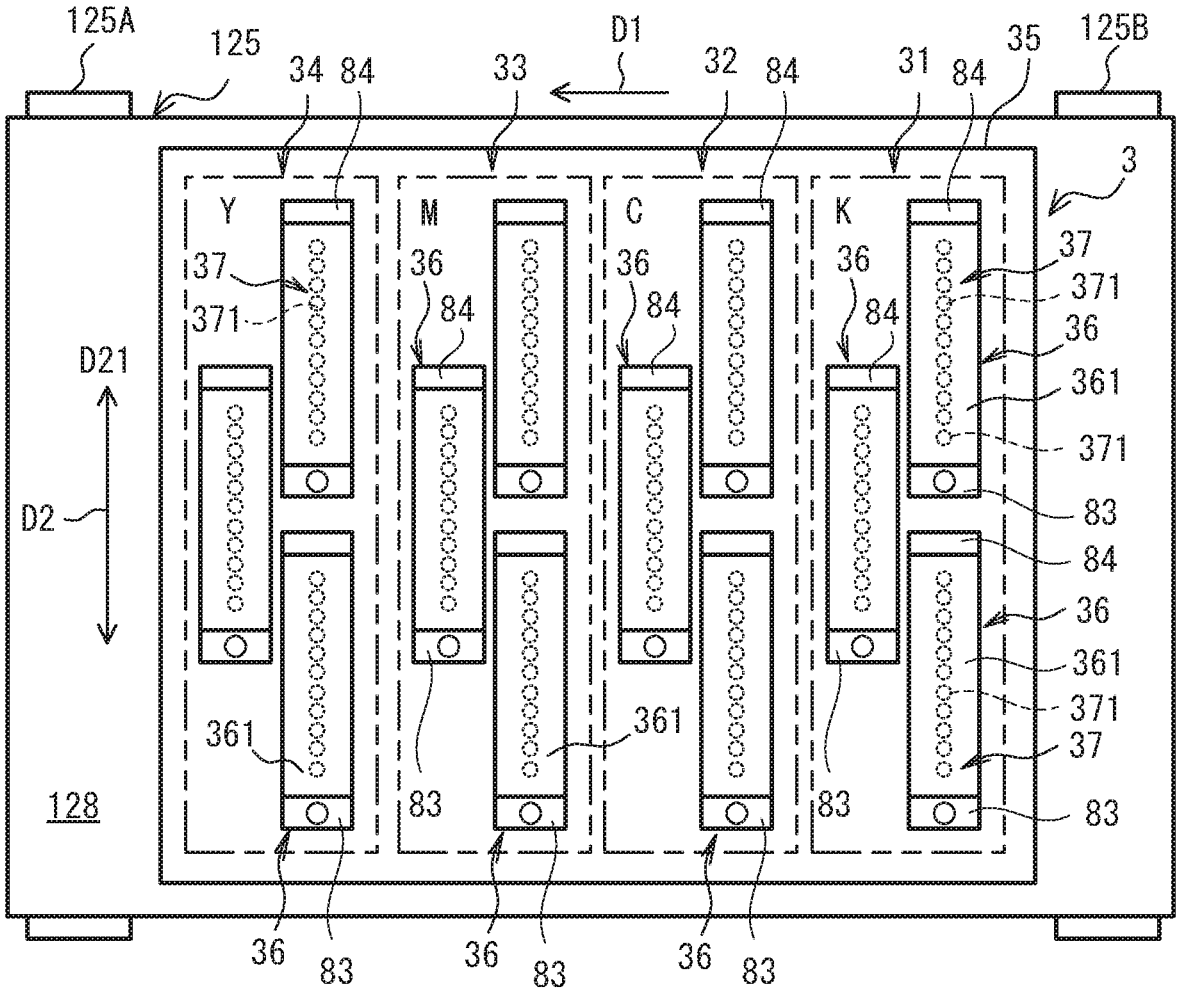
FIG. 4B is a plan view of the conveying device and the recorder.

As shown in FIG. 3, the image recording device 12 further includes a heater H1 that heats the ink on the ink supply path leading to a recording head 36 of each of the line heads 31 to 34 shown in FIG. 4B, and an ink temperature sensor TS1 that detects the temperature of the ink heated by the heater H1.

The controller 100 decides whether the ink temperature detected by the ink temperature sensor TS1 is a printable temperature, and permits, upon deciding that the ink temperature is the printable temperature, the recorder 3 to execute printing. Here, since the heater H1 heats the ink, the ink temperature can be efficiently raised before the ink is ejected. Accordingly, an increase in viscosity of the ink can be prevented, even under a low-temperature environment. As result, the ink ejection performance can be prevented from falling below an expected level. In addition, since the printing is executed only when the ink temperature is the printable temperature, expected printing quality can be secured. Thus, the "printable temperature" refers the temperature at which the expected ink ejection performance can be realized, in other words the temperature at which the printing may be permitted.

The configuration of the recorder 3 will be described in detail hereunder, with reference to the drawings. FIG. 4A illustrates the recorder and the conveying device. FIG. 4B illustrates the conveying device and the recorder viewed from above.

As shown in FIG. 4A, the conveying device 125 is located under the line heads 31 to 34. The conveying device 125 conveys the recording sheet P opposed to the ink ejection surface 361. The gap between the conveyor belt 128 and the ink ejection surface 361 is adjusted such that the gap between the surface of the recording sheet P and the ink ejection surface 361 during the printing operation becomes, for example, 1 mm.

The recorder 3 includes the line heads 31 to 34, as shown in FIG. 4B. The line heads 31 to 34 are elongate in a width direction D2 (width direction of recording sheet P), orthogonal to the transport direction D1 of the recording sheet P. The line heads 31 to 34 each have a width corresponding to the width of the widest recording sheet P that can be transported. The line heads 31 to 34 are fixed to the head frame 35, at predetermined intervals along the transport direction D1 of the recording sheet P The line heads 31 to 34 each include a plurality (e.g., three) of recording heads 36. Accordingly, the recorder 3 has twelve recording heads 36.

Figure 5A:
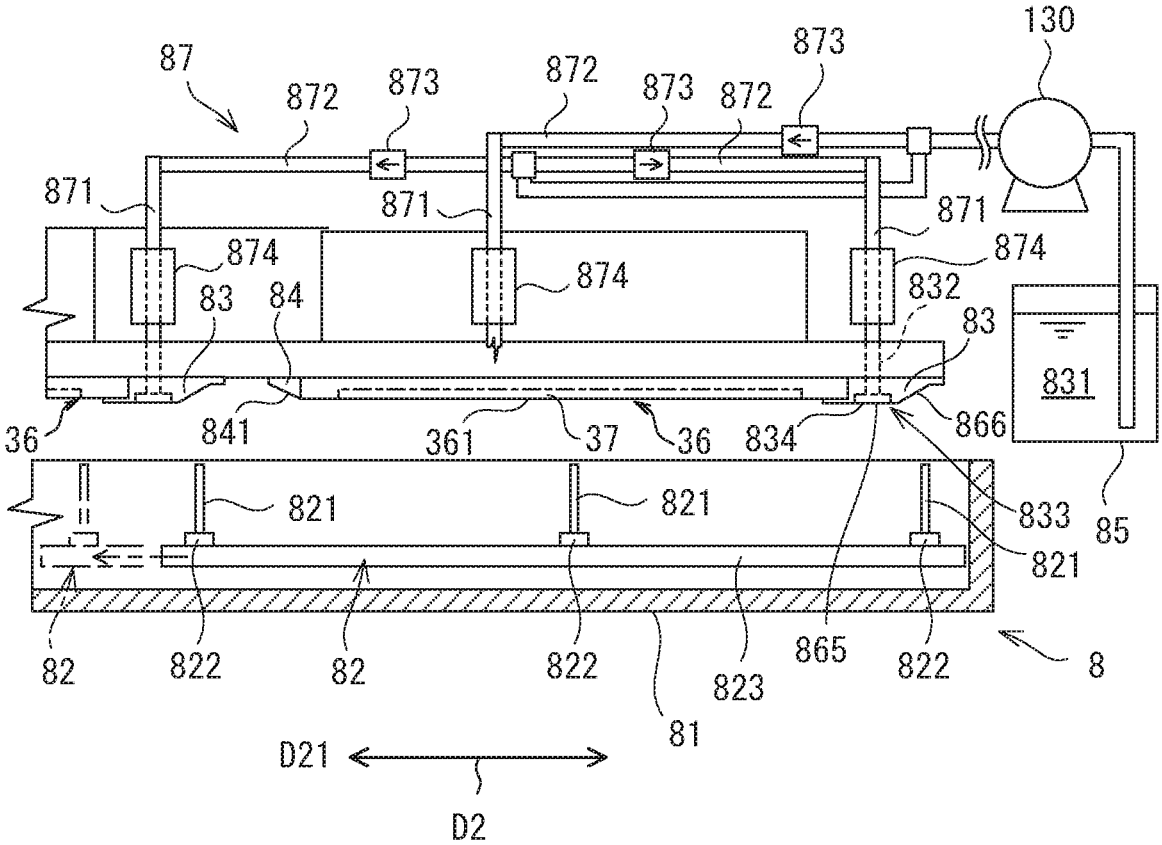
FIG. 5A is a partially seen-through side view showing a state where an ink tray and a wiper member of the cleaning device are located under the recorder.
Figure 5B:
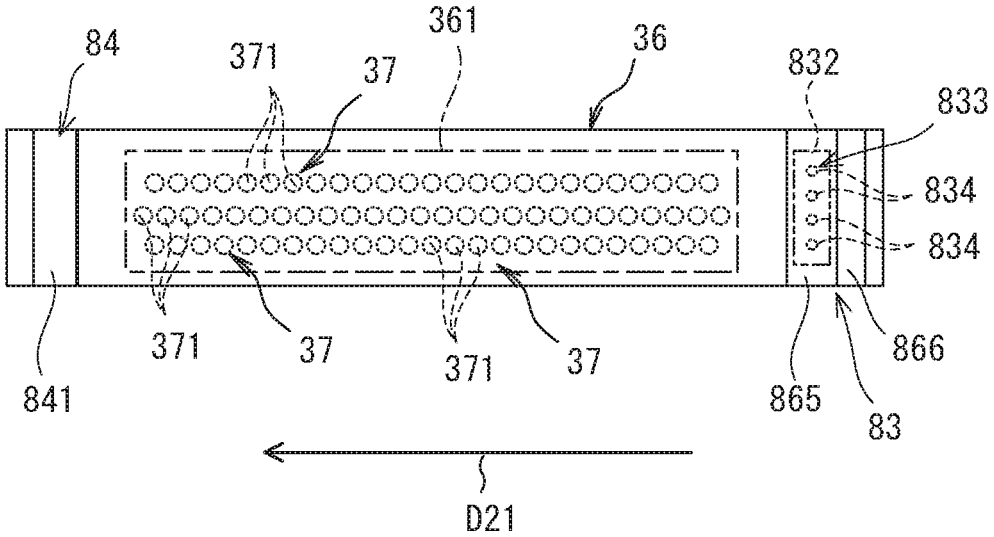
FIG. 5B is a schematic drawing showing the ink ejection surface of a recording head.

The recording head 36 includes a plurality of ink nozzles 37 each having an ink ejection port 371, from which the ink is ejected. Here, although the plurality of ink nozzles 37 are simply illustrated in a single row in FIG. 4B, actually the nozzles 37 are aligned in three rows in a checkerboard pattern, as shown in FIG. 5B to be subsequently referred to. The lower face of the recording head 36 is configured as the ink ejection surface 361 having the ink ejection port 371. In this embodiment, the line head 31 includes three recording heads 36, arranged in a checkerboard pattern along the width direction D2. Likewise, the remaining line heads 32 to 34 each include three recording heads 36, arranged in a checkerboard pattern along the width direction D2.

The recorder 3 is configured to eject the ink from the ink nozzles 37 of the respective recording heads 36 onto the recording sheet P being transported by the conveying device 125, to thereby record an image on the recording sheet P The ink may be ejected from the line heads 31 to 34 by, for example, a piezoelectric method using a piezoelectric element, or a thermal method including generating bubbles by heat.

As shown in FIG. 1, the ink tank 122 includes ink tanks 41, 42, 43, and 44 in which black, cyan, magenta, and yellow ink is respectively stored. The ink tanks 41 to 44 are respectively connected to the line heads 31 to 34 of the corresponding color, via a non-illustrated ink tube. Thus, the ink is supplied from the ink tanks 41 to 44 to the line heads 31 to 34, respectively. The ink employed in the ink jet recording apparatus 1 is normally formed of a solvent or water, containing a color material corresponding to each color.

The cleaning device 8 performs the cleaning operation (purging inclusive) when the conveying device 125 is located at the maintenance position as shown in FIG. 2, to thereby recover the function of the respective recording heads 36 of the line heads 31 to 34. The cleaning device 8 includes an ink tray 81 and a wiper unit 82, as shown in FIG. 1 and FIG. 5A. FIG. 5A is a partially seen-through side view showing a state where the ink tray and the wiper members of the cleaning device are located under the recorder. FIG. 5B illustrates the ink ejection surface of the recording head.

The ink tray 81 is for receiving the ink discharged from the ink nozzles 37 of the respective recording heads 36. The ink tray 81 is supported by a non-illustrated first moving mechanism, so as to move in a horizontal direction (left-right direction in FIG. 1). The first moving mechanism is a known drive mechanism, for example including a rack and pinion mechanism that converts the rotary motion of a gear coupled to a rotary shaft of a motor into a linear motion, to horizontally move the ink tray 81. The ink tray 81 is usually (e.g., during the printing operation) located at a retracted position downstream of the recorder 3 in the transport direction D1 (indicated by dash-dot lines in FIG. 2).

When an instruction to perform the cleaning operation is inputted, the ink tray 81 is moved by the first moving mechanism, to a space opposite the line heads 31 to 34 created when the conveying device 125 is moved to the maintenance position by the elevation mechanism 129 (indicated by solid lines in FIG. 2). The ink tray 81 is also supported so as to move in a vertical direction (up-down direction in FIG. 1). Upon reaching the position opposite the line heads 31 to 34, the ink tray 81 is moved upward, by the operation of the elevation mechanism 129 to move the conveying device 125 upward from the maintenance position by a predetermined distance.

The wiper unit 82 includes a plurality of wiper members 821 for cleaning the ink stuck to the ink ejection surface 361, each supported by a pair of side frames 823 via a stay 822. The wiper unit 82 is movable along the width direction D2. More specifically, the plurality of wiper members 821 are movable in a wiping direction D21 from a cleaning liquid supply device 83, in contact with the ink ejection surface 361 (see FIG. 9 to be subsequently referred to).

The plurality of wiper members 821 each clean the ink ejection surface 361 with the cleaning liquid 831 (see FIG. 9) supplied from the cleaning liquid supply device 83, by moving in the wiping direction D21.

The plurality of wiper members 821 are each formed of, for example, an elastomer, in a plate shape in a thickness of 1 mm to 2 mm, and thus possess elasticity. Examples of the suitable elastomer include urethane rubber, ethylene propylene diene monomer (EPDM), nitrile rubber (NBR), styrene rubber (SBR), chloroprene rubber, silicone rubber, and fluororubber. Thus, the wiper member 821 is formed of a material that does not absorb the cleaning liquid 831.

A plurality of stays 822 are arranged so as to extend in the transport direction D1, and coupled to the pair of side frames 823. In this embodiment, three stays 822 are provided, and four wiper members 821 are fixed to each of the stays 822. Thus, twelve wiper members 821 are provided, in accordance with the number of recording heads 36.

The pair of side frames 823 can be moved in the width direction D2, by a non-illustrated second moving mechanism. The second moving mechanism is a known drive mechanism, such as a rack and pinion mechanism. For example, when rotating force is applied to a non-illustrated pinion gear, the side frame 823 acting as the rack is caused to reciprocate along the width direction D2. Accordingly, the entirety of the wiper unit 82, the plurality of wiper members 821 inclusive, is caused to reciprocate along the width direction D2.

The recording head 36 includes a cleaning liquid supply device 83, located upstream of the ink ejection surface 361 in the wiping direction D21, as shown in FIG. 5A and FIG. 5B. The cleaning liquid supply device 83 includes a cleaning liquid supply surface 865 having a cleaning liquid supply port 834, from which the cleaning liquid 831 for wiping the ink ejection surface is supplied to the wiper member 821, and is located upstream of the ink ejection surface 361, in the wiping direction D21.

The cleaning liquid supply device 83 also includes an inclined surface 866, continuously extending from the cleaning liquid supply surface 865 to the upstream side in the wiping direction D21, and inclined upward with respect to the cleaning liquid supply surface 865, toward the upstream side in the wiping direction D21.

The recorder 3 includes twelve cleaning liquid supply devices 83, because of having twelve recording heads 36 as shown in FIG. 4B. The twelve cleaning liquid supply devices 83 each supply the cleaning liquid 831 for cleaning the ink ejection surface 361. The cleaning liquid supply device 83 supplies, when cleaning the ink ejection surface 361 with the wiper member 821, the cleaning liquid 831 stored in a space 832, through a cleaning liquid nozzle 833 communicating with the space 832.

Figure 9A:
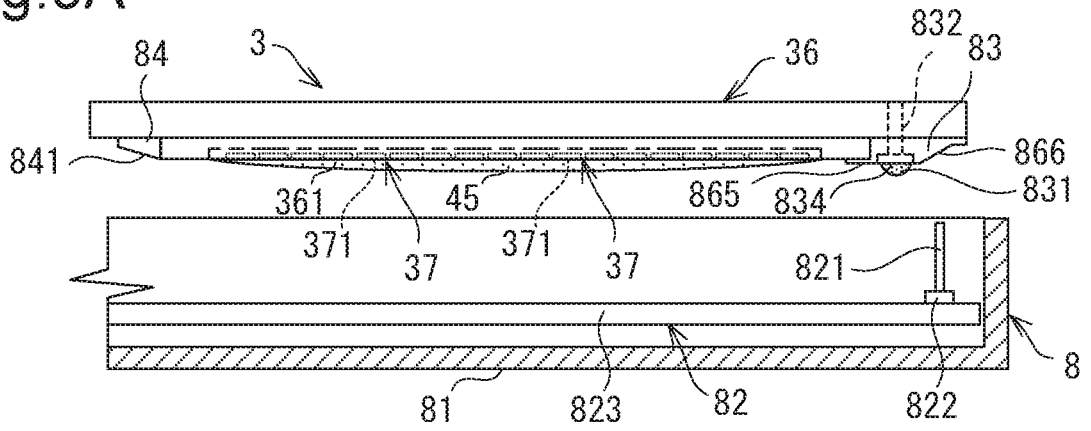
FIG. 9A to FIG. 9E are partially seen-through side views, for explaining a cleaning operation according to the first embodiment.

As shown in FIG. 9A to be subsequently referred to, the cleaning liquid 831 protrudes in a semispherical shape from the cleaning liquid supply port 834 of the cleaning liquid nozzle 833, when supplied to clean the ink ejection surface 361. In contrast, in occasions other than the cleaning of the ink ejection surface 361, the cleaning liquid 831 forms a concave meniscus inside the cleaning liquid nozzle 833. The concave meniscus can be formed by appropriately adjusting the inner diameter of the cleaning liquid nozzle 833, and the negative pressure applied by the space 832 to the inside of the cleaning liquid nozzle 833.

Further, the recording head 36 includes, as shown in FIG. 5A and FIG. 5B, a scattering prevention member 84 located downstream of the ink ejection surface 361 in the wiping direction D21. The scattering prevention member 84 includes an inclined surface 841, to be contacted by the wiper member 821, after the wiper member 821 has wiped the ink ejection surface 361. The inclined surface 841 continuously extends from the ink ejection surface 361 to the downstream side in the wiping direction D21, and is inclined upward with respect to the ink ejection surface 361, toward the downstream side in the wiping direction D21. Accordingly, the distortion of the wiper member 821 is gradually reduced while the wiper member 821 advances in the wiping direction D21 in contact with the inclined surface 841 of the scattering prevention member 84, and finally the wiper member 821 is gently parted from the inclined surface 841. Accordingly, the scattering of the liquid can be minimized, compared with the case where the scattering prevention member 84 is not provided. In addition, the scattering prevention member 84 is, for example, formed of a polyacetal resin (POM). The ink ejection surface 361 of the recording head 36 is provided with, for example, a fluorine-based water-repellent film. Therefore, the scattering prevention member 84 is less water-repellent than the ink ejection surface 361. As result, even though the cleaning liquid remains on the scattering prevention member 84, the droplet of the cleaning liquid is prevented from contacting the recording sheet, since the droplet has a lower height.

A cleaning liquid tank 85 is provided to accommodate the cleaning liquid 831, as shown in FIG. 5A. Here, a material obtained by eliminating the color material from the ink may be employed as the cleaning liquid 831. In other words, a material predominantly composed of a solvent or water may be employed as the cleaning liquid 831. A surfactant, and/or preservative and fungicide may be added to the cleaning liquid 831, if need be.

Figure 6:
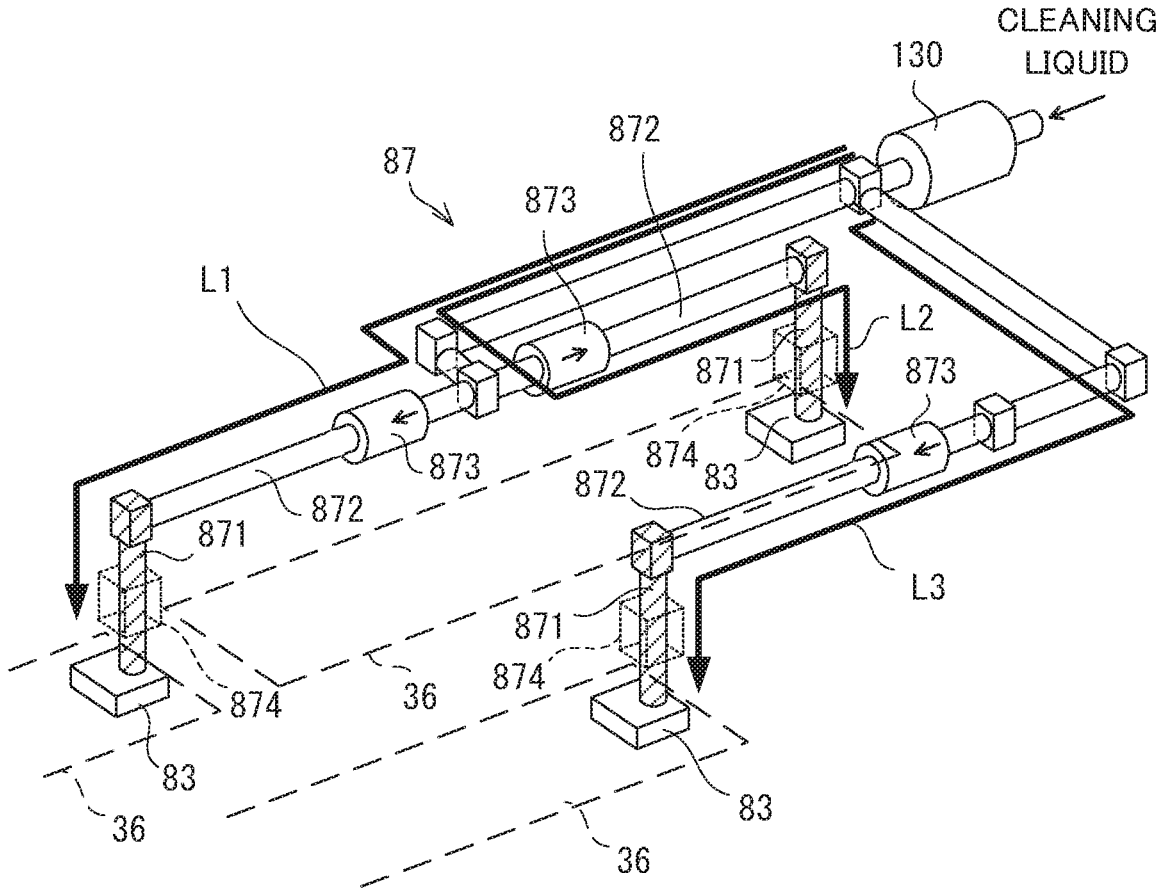
FIG. 6 is a schematic perspective view showing a cleaning liquid flow path for supplying a cleaning liquid to a line head.

FIG. 6 schematically illustrates a cleaning liquid flow path, through which the cleaning liquid is supplied to one of the line heads. FIG. 6 shows the cleaning liquid flow path 87 for the line head 31. The cleaning liquid flow path 87 includes pipes for conducting the cleaning liquid 831 from the cleaning liquid tank 85 to the respective cleaning liquid supply devices 83 of the three recording heads 36. The cleaning liquid flow path 87 is provided for each of the line heads 31 to 34. In other words, one cleaning liquid flow path 87 is provided for each color. The configuration of the cleaning liquid flow path 87 for the remaining line heads 32 to 34 is the same as that for the line head 31.

The cleaning liquid flow path 87 includes vertical tubular members 871 and horizontal tubular members 872. The vertical tubular members 871, which are hatched in FIG. 6, each have one end connected to the cleaning liquid supply device 83, and extend upward therefrom to the other end. The horizontal tubular members 872 each have one end connected to the upper end of the vertical tubular member 871, and horizontally extend to the other end. The capacity of the horizontal tubular member 872 is, for example, five times the total capacity of the cleaning liquid supply device 83 and the vertical tubular member 871.

The horizontal tubular member 872 also includes a check valve 873 that guides the cleaning liquid 831 toward the vertical tubular member 871. The check valve 873 restricts the cleaning liquid 831 from reversely flowing toward the cleaning liquid tank 85, thereby allowing the cleaning liquid 831 to be stably supplied.

Further, as shown in FIG. 5A and FIG. 6, a heating element 874 is provided on the cleaning liquid flow path 87, to apply heat to the cleaning liquid flow path 87. The heating element 874 is, for example, provided on each of the three vertical tubular members 871 in the cleaning liquid flow path 87.

Figure 7A:
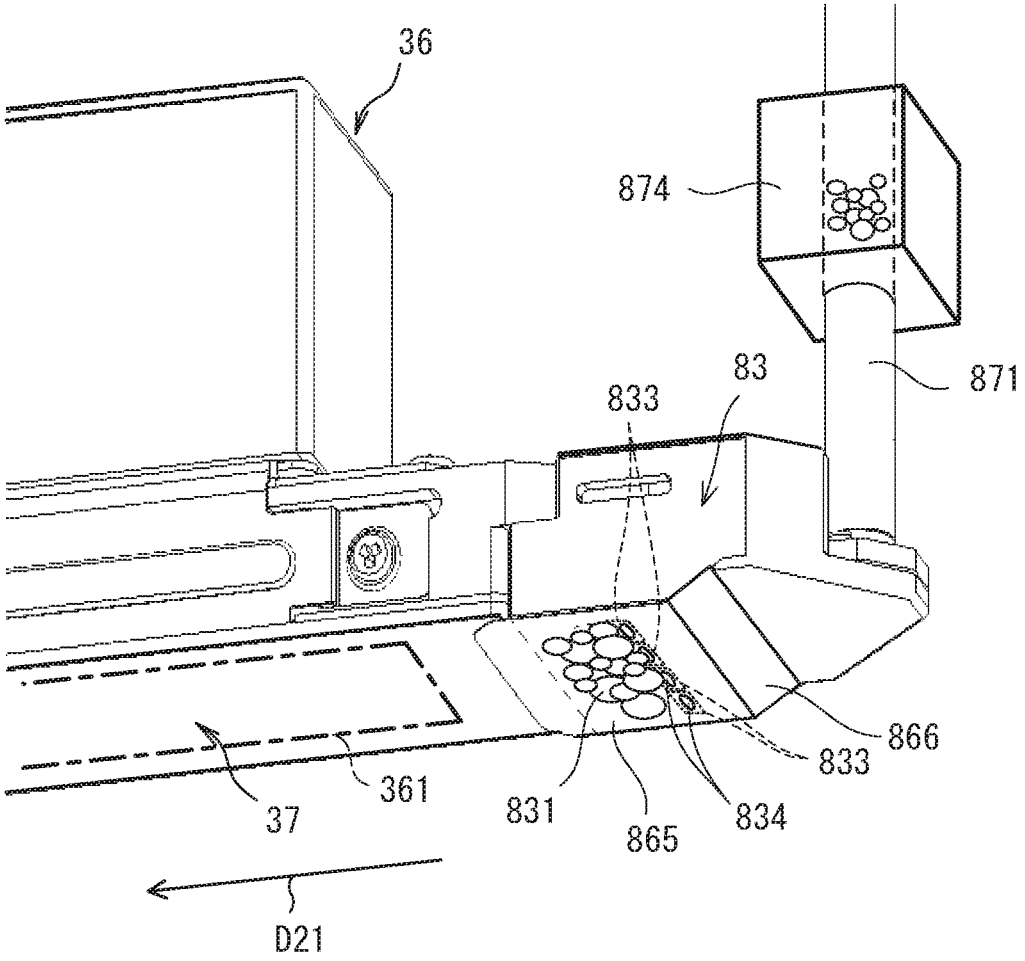
FIG. 7A is a partial perspective view of a portion of the recording head on the side of a cleaning liquid supply device, seen from an obliquely lower position.

FIG. 7A is a partial perspective view of a portion of the recording head on the side of the cleaning liquid supply device, seen from an obliquely lower position. The heating element 874 is attached to the outer circumferential portion of the vertical tubular member 871 as shown in FIG. 5A and FIG. 7A, to heat the vertical tubular member 871. The heating element 874 is, for example, a ceramic heater. The ceramic heater generates heat, when a current is supplied thereto. Here, the heating element 874 may be of a different type, such as an electric heater or a pipe heater.

The cleaning liquid pump 130 serves to provide the force to cause the cleaning liquid 831 to move through the cleaning liquid flow path 87, and come out from the cleaning liquid supply port 834. The cleaning liquid flow path 87 is connected to the output side of the cleaning liquid pump 130, and an input side flow path connected to the cleaning liquid tank 85 is connected to the input side of the cleaning liquid pump 130. One cleaning liquid pump 130 is provided for each cleaning liquid flow path 87, in other words one for each color. The cleaning liquid pump 130 exemplifies the driving device in What is claimed is.

As shown in FIG. 6, flow path lengths L1, L2 and L3 from the cleaning liquid pump 130, to the respective cleaning liquid supply devices 83 of the three recording heads 36 of the same color, are the same as each other. Accordingly, in the cleaning liquid flow path 87 composed of the vertical tubular members 871 and the horizontal tubular members 872, the same amount of the cleaning liquid can be supplied, from each of the cleaning liquid supply devices 83.

Figure 7B:
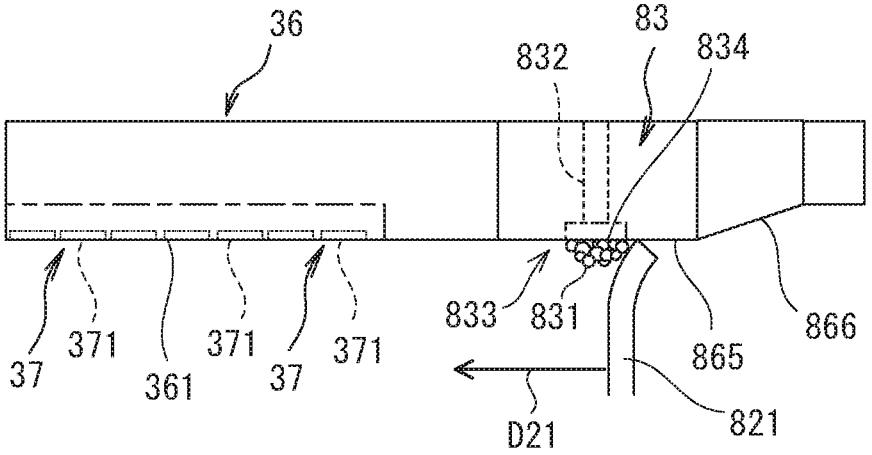
FIG. 7B is a schematic side view of the portion of the recording head on the side of the cleaning liquid supply device.

Referring to FIG. 7A, when the cleaning liquid pump 130 applies the force to squeeze out the cleaning liquid 831 from the cleaning liquid supply port 834, while bubbles are generated in the vertical tubular member 871 by the heat from the heating element 874, the cleaning liquid 831 containing the bubbles in the vertical tubular member 871 is moved toward the cleaning liquid supply port 834, and the cleaning liquid 831 containing the bubbles is squeezed out from the cleaning liquid supply port 834. FIG. 7B is a schematic side view of the portion of the recording head on the side of the cleaning liquid supply device. As shown in FIG. 7B, the controller 100 controls the cleaning operation, including causing the wiper member 821 to wipe the ink ejection surface 361 with the cleaning liquid 831 containing the bubbles.

Figure 8:
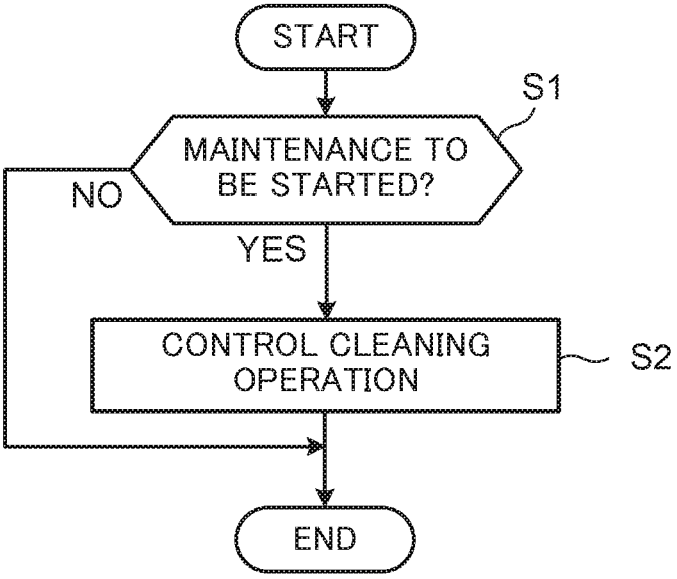
FIG. 8 is a flowchart showing an operation performed by the ink jet recording apparatus according to the first embodiment.

Hereunder, an exemplary operation performed by the control device 10 of the ink jet recording apparatus 1 according to the first embodiment will be described, with reference to the drawings. FIG. 8 is a flowchart showing the operation performed by the ink jet recording apparatus according to the first embodiment.

Referring to FIG. 8, the controller 100 of the control device 10 decides whether maintenance is to be started (S1). More specifically, for example, when a predetermined time has elapsed after the ink jet recording apparatus 1 is turned on, without the printing operation having been started, the controller 100 decides that the maintenance is to be started (YES at S1). Then the controller 100 moves the conveying device 125 to the maintenance position, and moves the cleaning device 8 to the position right under the recorder 3, as shown in FIG. 2. The timing to start the maintenance is not limited to the above, but may be specified as, for example, when an instruction to turn off the ink jet recording apparatus 1 is inputted, when the operation time of the ink jet recording apparatus 1 has reached a predetermined time, or when the number of sheets printed by the ink jet recording apparatus 1 has exceeded a predetermined cumulative number of sheets.

Upon deciding that the maintenance is to be started (YES at S1), the controller 100 executes the control of the cleaning operation (S2). FIG. 9A to FIG. 9E are partially seen-through side views for explaining the cleaning operation according to the first embodiment.

In FIG. 9A, the controller 100 supplies purge ink 45 to the recording head 36, so that the purge ink 45 is discharged from the ink ejection port 371 of the ink nozzle 37. Accordingly, thickened ink, foreign matters, and bubbles inside the ink nozzle 37 are discharged toward the ink tray 81, together with the purge ink 45 supplied to the ink nozzle 37. Such a purging operation eliminates clogging of the ink nozzle 37. The ink and other substances discharged to the ink tray 81 are discharged to a predetermined waste ink deposit, from a drain port provided on the bottom portion of the ink tray 81, through a non-illustrated ink tube.

When the purging operation is finished, the cleaning device 8 performs the cleaning operation, using the cleaning liquid 831 containing the bubbles. The cleaning operation is performed to wipe off the purge ink 45 stuck to the ink ejection surface 361, and ink stuck to the proximity of the ink ejection port 371, with the wiper member 821.

In the cleaning operation, the controller 100 supplies power to the heating element 874 for a predetermined period, to cause the heating element 874 to generate heat. When the heating element 874 heats the vertical tubular member 871, bubbles are generated in the cleaning liquid 831 in the vertical tubular member 871. The controller 100 then squeezes out a predetermined amount (e.g., 1.5 mL) of cleaning liquid 831 containing the bubbles, so that the cleaning liquid 831 containing bubbles is made to protrude in a semispherical shape from the cleaning liquid supply port 834 of the cleaning liquid supply device 83 (see FIG. 7A and FIG. 9A).

Here, the predetermined amount (e.g., 1.5 mL) refers to the total dispensing amount of the line heads 31 to 34, in other words the total for all the four colors. The cleaning liquid 831 containing bubbles may be supplied at the same time as the discharging of the purge ink 45, or before or after the discharging of the purge ink 45.

The controller 100 disconnects the power to the heating element 874, when a predetermined time has elapsed. Alternatively, the controller 100 may control the power supply to the heating element 874, so as to maintain the heating temperature of the heating element 874 at a predetermined level.

Figure 9B:
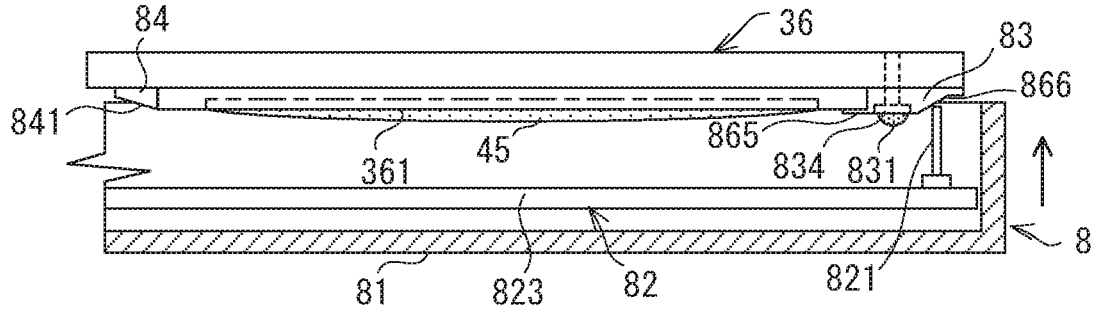
Figure 9C:
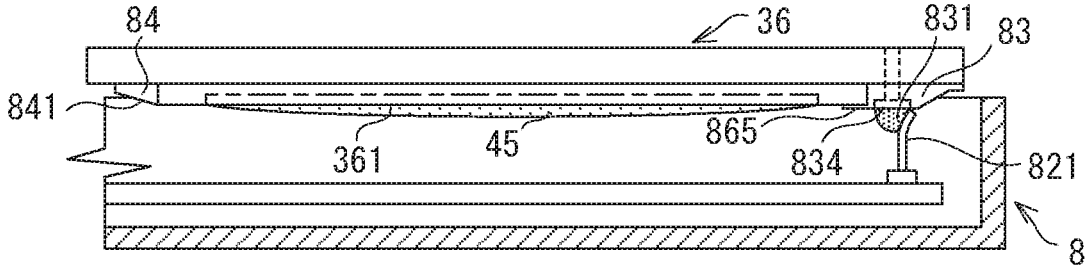
Figure 9D:
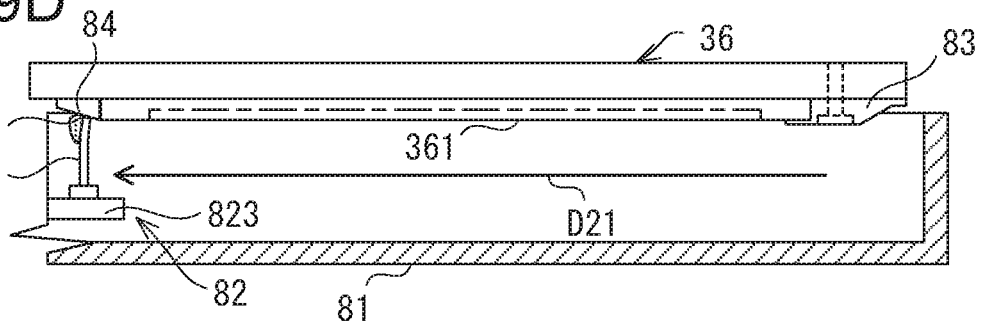

Referring to FIG. 9B to FIG. 9D, upon supplying the cleaning liquid 831 containing the bubbles, the controller 100 drives the non-illustrated second moving mechanism to horizontally move the wiper unit 82 in the wiping direction D21. To be more detailed, the controller 100 locates the wiper member 821 at a movement start position (see FIG. 9B), and then moves the wiper member 821 from the movement start position as far as an end position where the wiper member 821 contacts the scattering prevention member 84 (see FIG. 9C and FIG. 9D). In this process, the wiper member 821 moves through the inclined surface 866, the cleaning liquid supply surface 865, and the ink ejection surface 361, in contact therewith, until contacting the scattering prevention member 84.

As shown in FIG. 7B and FIG. 9D, the wiper member 821 wipes off the purge ink 45 stuck to the ink ejection surface 361, and ink stuck to the proximity of the ink ejection port 371, while moving along the ink ejection surface 361 in contact therewith. The residual ink and other substances wiped off by the wiper member 821 move downward together with the cleaning liquid 831 along the surface of the wiper member 821, and then drop to the ink tray 81.

Figure 9E:
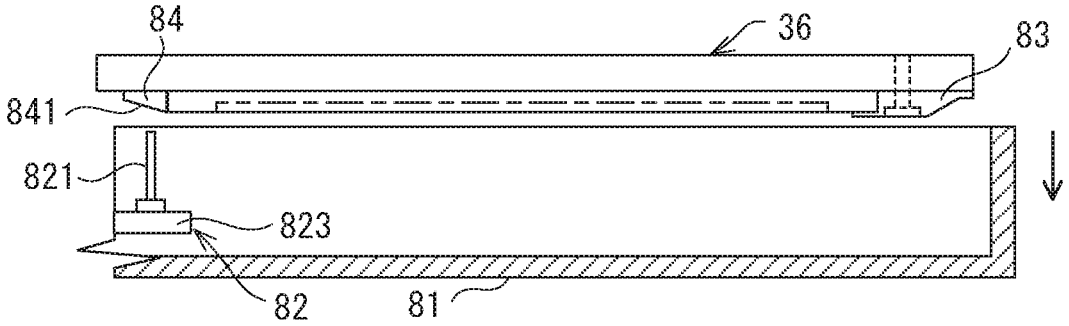

Thereafter, the controller 100 drives the elevation mechanism 129 to cause the conveying device 125 to descend by a predetermined distance and return to the maintenance position, thereby moving the wiper member 821 away from the scattering prevention member 84, as shown in FIG. 9E.

The controller 100 then drives the elevation mechanism 129 to cause the conveying device 125 to descend to the maintenance position (see FIG. 2), and drives the first moving mechanism to cause the ink tray 81 of the cleaning device 8 to return to the retracted position (see FIG. 1). Further, the controller 100 drives the elevation mechanism 129 to cause the conveying device 125 to the recording position (position shown in FIG. 1). At this point, the controller 100 finishes the operation shown in FIG. 8.

With the configuration according to the first embodiment, the heating element 874 applies heat to the cleaning liquid flow path 87, thereby generating bubbles in the cleaning liquid flow path 87. The controller 100 controls the cleaning operation, including wiping the ink ejection surface 361 of the recording head 36 with the wiper member 821, using the cleaning liquid 831 containing the bubbles. Accordingly, the gas-liquid interface of the bubbles can be made to pass over the ink stuck to the proximity of the ink ejection port 371, so that mist stuck to the nozzle surface, and the ink stuck to the proximity of the ink ejection port 371 can be effectively removed.

Here, with the ink jet recording apparatus according to the foregoing background art, although the mechanism for wiping the nozzle surface with the wiper carrying the cleaning liquid can effectively remove mist stuck to the nozzle surface, the mist may still remain unremoved. In addition, the ink stuck to the proximity of the ink ejection port is unable to be removed, and therefore the adhered ink is unable to be effectively removed.

With the configuration according to this embodiment, unlike the above, the adhered ink and other substances can be effectively removed.

The heating element 874 is provided in contact with the outer circumferential portion of the cleaning liquid flow path 87, to heat the same. Therefore, the cleaning liquid flow path 87 can be directly heated, and bubbles can be efficiently and stably generated in the cleaning liquid flow path 87. As result, the cleaning operation with the cleaning liquid 831 containing bubbles can be stably performed.

In addition, the heating element 874 is provided in contact with the outer circumferential portion of the vertical tubular member 871, at a position close to the cleaning liquid supply device 83, to heat the vertical tubular member 871. Therefore, the vertical tubular member 871 can be directly heated, and bubbles can be efficiently and stably generated in the vertical tubular member 871. As result, the cleaning operation with the cleaning liquid 831 containing bubbles can be stably performed. Further, the bubbles generated in the vertical tubular member 871 at the position adjacent to the cleaning liquid supply device 83 are immediately supplied thereto, and therefore the flow path of the bubbles between the position of generation and the position of use is sufficiently short, which prevents the bubbles from residing in the horizontal tubular member 872 distant from the cleaning liquid supply device 83.

To control the cleaning operation, the controller 100 squeezes out the cleaning liquid 831 containing bubbles from the cleaning liquid supply port 834, moves the wiper member 821 carrying the cleaning liquid 831 containing bubbles in the wiping direction D21, from the movement start position as far as the end position ahead of the ink ejection surface 361, and then moves the wiper member 821 away from the end position. Thus, the ink ejection surface 361 of the recording head 36 is wiped by the wiper member 821 carrying the cleaning liquid 831 containing bubbles. Accordingly, the gas-liquid interface of the bubbles can be made to pass over the ink stuck to the proximity of the ink ejection port 371, so that the mist stuck to the nozzle surface and the ink stuck to the proximity of the ink ejection port 371 can be effectively removed. In other words, when the cleaning liquid 831 containing bubbles is used for the wiping, higher cleaning performance can be attained compared with the case of wiping with the cleaning liquid 831 without the bubbles, and therefore the adhered ink and mist can be effectively removed.

The wiper member 821 is formed of a material that is non-absorptive of the cleaning liquid 831, and therefore the cleaning liquid 831 containing bubbles remains on the surface of the wiper member 821. Then the wiper member 821, carrying the cleaning liquid 831 containing bubbles stuck to the surface, moves in the wiping direction D21 in contact with the ink ejection surface 361. Accordingly, the ink stuck to the proximity of the ink ejection port 371 of the ink ejection surface 361 can be effectively removed.

To control the cleaning operation, the controller 100 squeezes out the purge ink from the ink ejection port 371 of the recording head 36, and also the cleaning liquid 831 containing bubbles from the cleaning liquid supply port 834, moves the wiper member 821 carrying the cleaning liquid 831 containing bubbles in the wiping direction D21, from the movement start position as far as the end position ahead of the ink ejection surface 361, and then moves the wiper member 821 away from the end position. Squeezing out the purge ink from the ink ejection port 371 contributes to eliminating clogging of the ink ejection port 371. Then the ink ejection surface 361 of the recording head 36 is wiped by the wiper member 821 carrying the cleaning liquid 831 containing bubbles. Accordingly, the gas-liquid interface of the bubbles can be made to pass over the ink stuck to the proximity of the ink ejection port 371, so that the mist stuck to the nozzle surface and the ink stuck to the proximity of the ink ejection port 371 can be effectively removed.

The inclined surface 866 of the cleaning liquid supply device 83 continuously extends from the cleaning liquid supply surface 865 toward the upstream side in the wiping direction D21, and is inclined upward with respect to the cleaning liquid supply surface 865, toward the upstream side in the wiping direction D21. The movement start position is set to a predetermined position where the tip portion of the wiper member 821 is located right under the inclined surface 866, and in an upper region of a plane including the cleaning liquid supply surface 865. Such a setting allows the wiper member 821 to properly contact the cleaning liquid supply surface 865 and the ink ejection surface 361.

Further, to control the cleaning operation, the controller 100 squeezes out the purge ink from the ink ejection port 371 of the recording head 36, and also the cleaning liquid 831 from the cleaning liquid supply port 834, moves the wiper member 821 in the wiping direction D21 from the movement start position and through the ink ejection surface 361, until reaching the end position where the wiper member 821 contacts the scattering prevention member 84, and then moves the wiper member 821 away from the end position. Since the wiper member 821 is moved away from the scattering prevention member 84, the liquid (ink and/or cleaning liquid) is kept from remaining on the ink ejection surface 361. In addition, the scattering prevention member 84 prevents the liquid from splashing around, when the wiper member 821 is parted from the end position.

Figure 10:
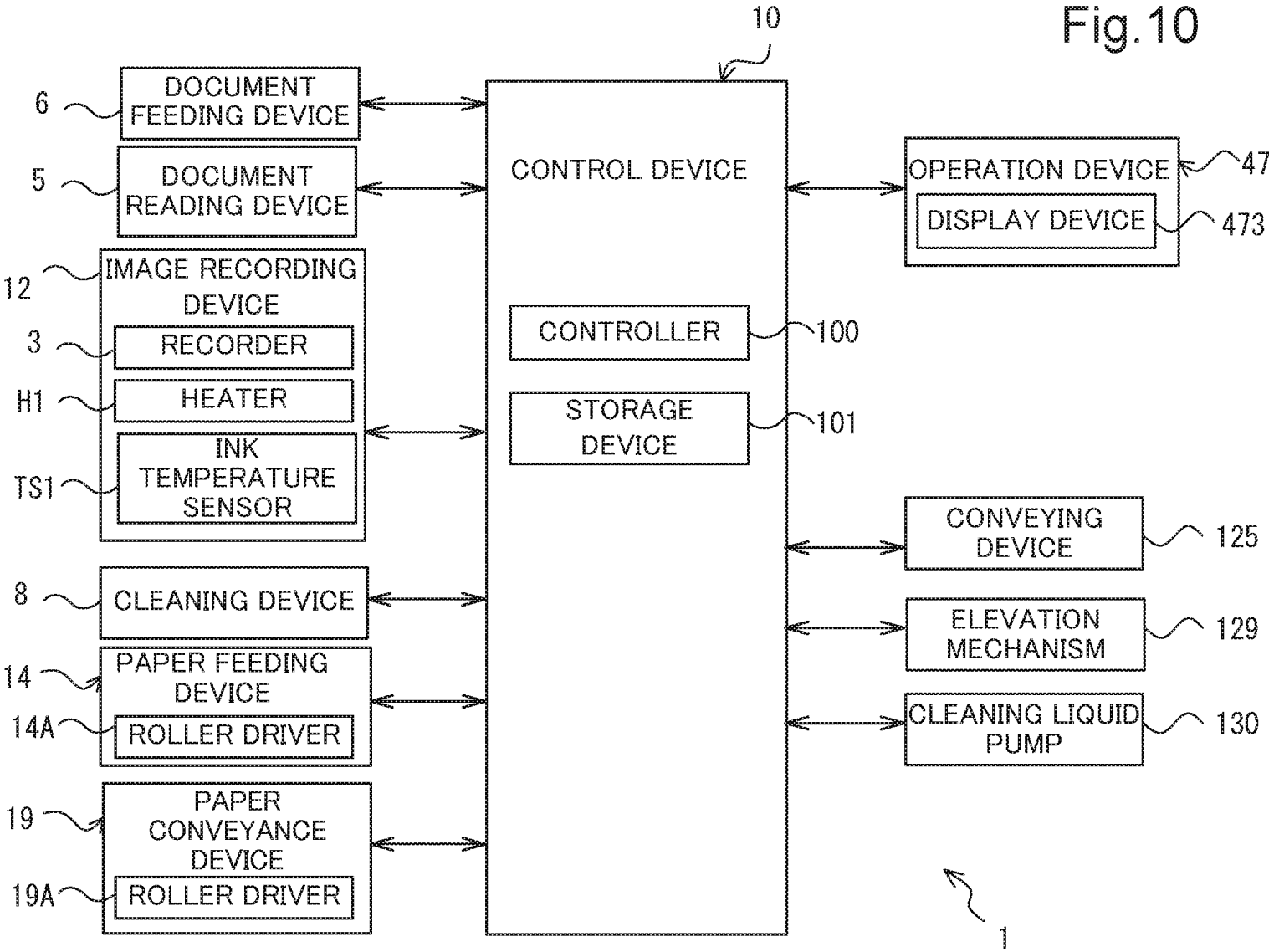
FIG. 10 is a functional block diagram showing an essential internal configuration of the ink jet recording apparatus according to a second embodiment.
Figure 11A:
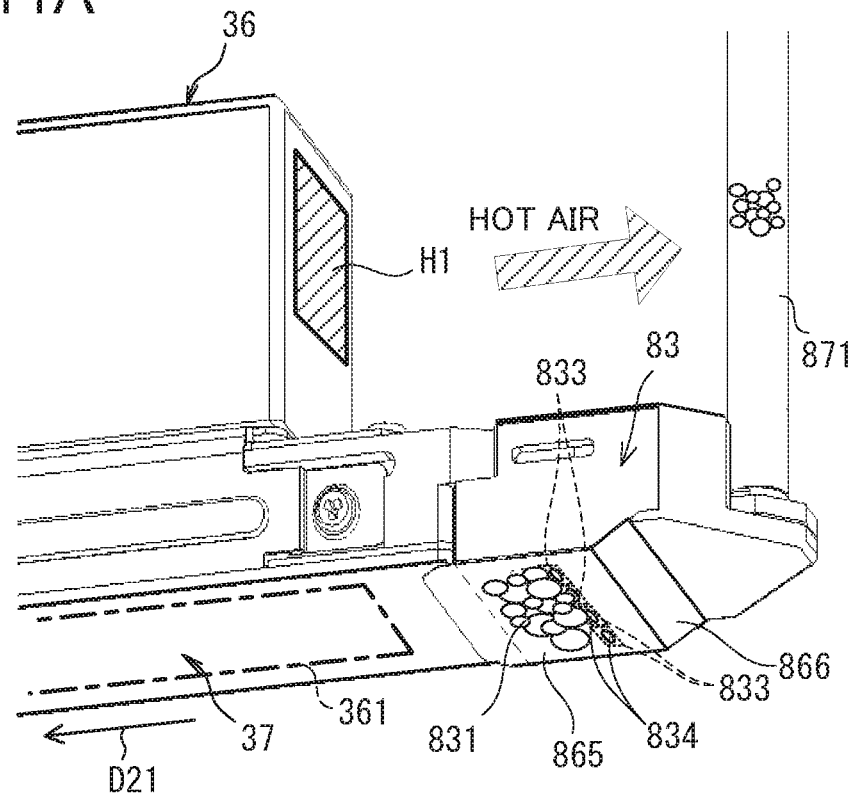
FIG. 11A is a partial perspective view of the portion of the recording head on the side of the cleaning liquid supply device according to the second embodiment, seen from an obliquely lower position.

Hereunder, the ink jet recording apparatus 1 according to a second embodiment will be described. FIG. 10 is a functional block diagram showing an essential internal configuration of the ink jet recording apparatus according to the second embodiment. FIG. 11A is a partial perspective view of the portion of the recording head on the side of the cleaning liquid supply device according to the second embodiment, seen from an obliquely lower position.

In the first embodiment, the single-purpose heating element 874 for generating bubbles (see FIG. 3) is provided on the cleaning liquid flow path 87. In the second embodiment, however, the heater H1 of the recording head 36 is utilized to generate bubbles in the cleaning liquid flow path 87 as shown in FIG. 11A, instead of providing the heating element 874 as in the first embodiment.

The heater H1 is provided, as shown in FIG. 11A, on the face of the recording head 36 opposed to the vertical tubular member 871. The heater H1 serves, as in the first embodiment, to heat the ink on the ink supply path leading to the recording head 36. The cleaning liquid flow path 87 is installed such that the vertical tubular member 871, a part thereof, is located within a range where the heat from the heater H1 can reach. Accordingly, the heat of the heater H1 is transmitted by the convection of gas (air) present between the heater H1 and the cleaning liquid flow path 87 (more accurately, vertical tubular member 871), so that the vertical tubular member 871 is heated. In other words, the vertical tubular member 871 can be heated because of the transmission of the hot air from the heater H1 to the vertical tubular member 871.

Figure 11B:
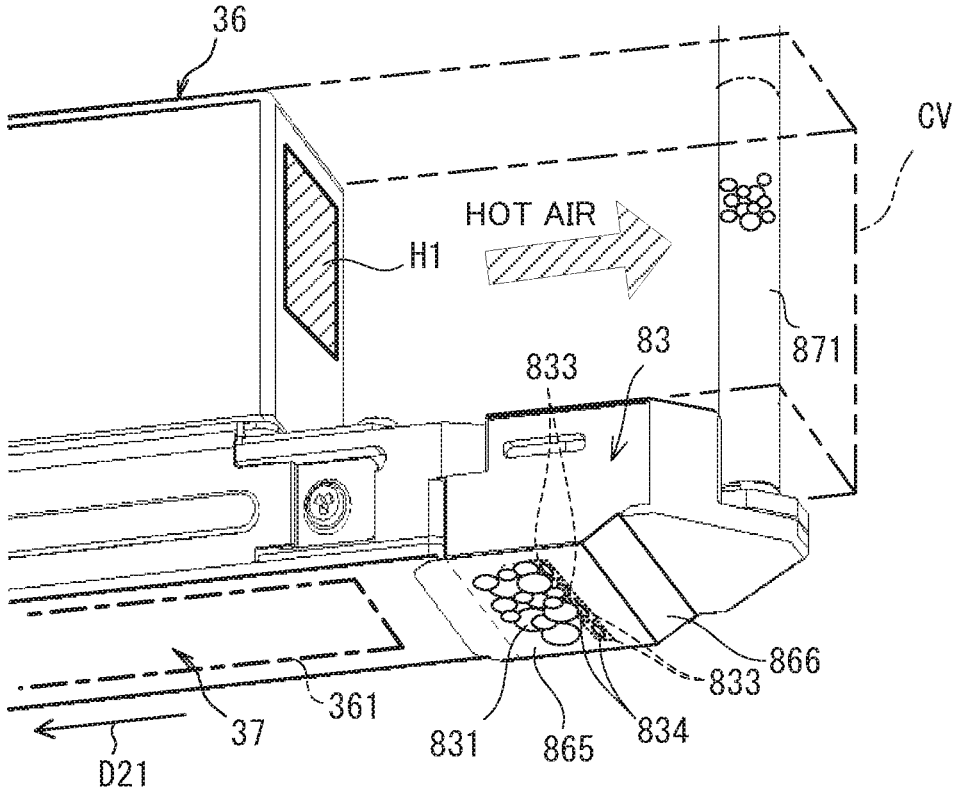
FIG. 11B is a partial perspective view of the portion of the recording head on the side of the cleaning liquid supply device according to a variation of the second embodiment, seen from an obliquely lower position.

Here, the recording head 36 may further include an enclosure member CV for conducting the hot air from the heater H1 toward the vertical tubular member 871, as shown in FIG. 11B. FIG. 11B is a partial perspective view of the portion of the recording head on the side of the cleaning liquid supply device according to a variation of the second embodiment, seen from an obliquely lower position. The enclosure member CV is located so as to enclose the space between the heater H1 and the vertical tubular member 871, and therefore a larger portion of the hot air from the heater H1 can be transmitted to the vertical tubular member 871.

Further, the control device 10 acts also as a storage device 101, in addition to the controller 100, when the processor executes the control program, for example stored in a built-in non-volatile memory. The storage device 101 may be a storage device such as a HDD.

Figures 12A, 12B:
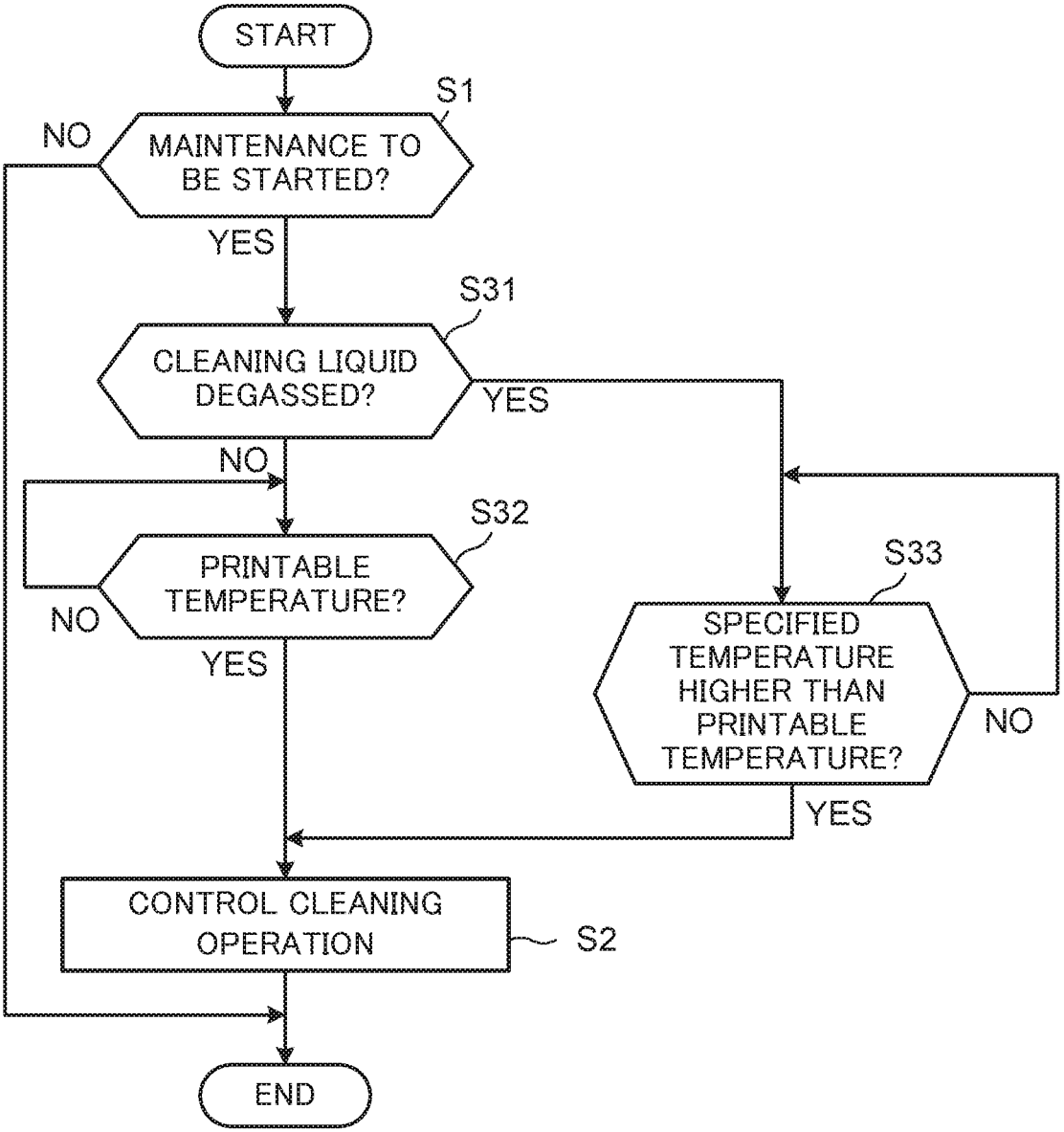
FIG. 12A is a flowchart showing an operation performed by the ink jet recording apparatus according to the second embodiment.
FIG. 12B is a table showing degasification information stored in a storage device.

Hereunder, an operation performed by the control device 10 of the ink jet recording apparatus 1 according to the second embodiment will be described, with reference to the drawings. FIG. 12A is a flowchart showing an operation performed by the ink jet recording apparatus according to the second embodiment. FIG. 12B is a table showing degasification information stored in a storage device.

The degasification information shown in FIG. 12B, indicating whether the cleaning liquid 831 stored in the cleaning liquid tank 85 is degassed, is stored in advance in the storage device 101. More specifically, the storage device 101 contains the degasification information that indicates "undegassed" when the cleaning liquid 831 in the cleaning liquid tank 85 has not been degassed, and the degasification information that indicates "degassed" when the cleaning liquid 831 in the cleaning liquid tank 85 has been degassed.

The steps S1 and S2 in FIG. 12A are the same as those of the first embodiment, and therefore the steps S31 to S33 in FIG. 12A will be described hereunder.

Upon deciding that the maintenance is to be started (YES at S1), the controller 100 decides whether the cleaning liquid has been degassed (S31). More specifically, the controller 100 reads out the degasification information stored in the storage device 101 (see FIG. 12B), and decides that the cleaning liquid has not been degassed, when the degasification information indicates "undegassed" (NO at S31).

When the storage device 101 indicates that the cleaning liquid has not been degassed, the controller 100 decides whether the ink temperature detected by the ink temperature sensor TS1 accords with the printable temperature (S32). Upon deciding that the ink temperature accords with the printable temperature (YES at S32), the controller 100 performs the control of the cleaning operation (S2). Upon deciding that the ink temperature does not accord with the printable temperature (NO at S32), the operation returns to S32, and the controller 100 stands by for the decision that the ink temperature accords with the printable temperature, before starting the control of the cleaning operation.

In contrast, when the degasification information stored in the storage device 101 (see FIG. 12B), read out at S31, indicates that the cleaning liquid has been degassed, the controller 100 decides that the cleaning liquid has been degassed (YES at S31).

When the storage device 101 indicates that the cleaning liquid has been degassed (YES at S31), the controller 100 decides whether the ink temperature detected by the ink temperature sensor TS1 accords with a specified temperature higher than the printable temperature (S33). Upon deciding that the ink temperature accords with the specified temperature higher than the printable temperature (YES at S33), the controller 100 performs the control of the cleaning operation (S2). Upon deciding that the ink temperature does not accord with the specified temperature (NO at S33), the operation returns to S33, and the controller 100 stands by for the decision that the ink temperature accords with the specified temperature, before starting the control of the cleaning operation.

With the configuration according to the second embodiment, the heat of the heater H1 is transmitted by the convection of the gas present between the heater H1 and the cleaning liquid flow path 87 (more accurately, vertical tubular member 871), and thus heats the vertical tubular member 871. Therefore, the heater H1 of the recording head 36 can be effectively utilized, because the heat of the heater H1 is also used to generate bubbles in the cleaning liquid flow path 87. Further, the mentioned configuration eliminates the need to additionally provide the heating element 874 exclusively for the cleaning liquid flow path 87, thereby suppressing an increase in number of parts.

The vertical tubular member 871, a part of the cleaning liquid flow path 87, is located within the reach of the heat from the heater H1, thus to be heated thereby. It was confirmed that, in the case where the cleaning liquid 831 in the cleaning liquid flow path 87 has not been degassed, bubbles were generated in the cleaning liquid 831 in the vertical tubular member 871, when the ink temperature detected by the ink temperature sensor TS1 reaches the printable temperature. When the storage device 101 indicates that the cleaning liquid has not been degassed, the controller 100 decides whether the ink temperature detected by the ink temperature sensor TS1 accords with the printable temperature, and upon deciding that the ink temperature accords with the printable temperature, the controller 100 performs the control of the cleaning operation. Accordingly, the ink ejection surface 361 can be cleaned with the cleaning liquid 831 containing bubbles, and the ink stuck to the proximity of the ink ejection port 371 can be effectively removed. On the other hand, upon deciding that the ink temperature does not accord with the printable temperature, the controller 100 stands by for the decision that the ink temperature accords with the printable temperature, before starting the control of the cleaning operation. Such an arrangement prevents the cleaning liquid 831 without bubbles from being used to clean the ink ejection surface 361, thereby ensuring that the cleaning liquid 831 containing bubbles is utilized for the cleaning operation.

It was also confirmed that, in the case where the cleaning liquid 831 in the cleaning liquid flow path 87 has been degassed, bubbles were not generated despite the ink temperature detected by the ink temperature sensor TS1 having reached the printable temperature, but that bubbles were generated in the cleaning liquid 831 in the vertical tubular member 871, when the ink temperature reaches the specified temperature higher than the printable temperature. Accordingly, when the storage device 101 indicates that the cleaning liquid has been degassed, the controller 100 decides whether the ink temperature detected by the ink temperature sensor TS1 accords with the specified temperature higher than the printable temperature, and upon deciding that the ink temperature accords with the specified temperature, the controller 100 performs the control of the cleaning operation. Therefore, the ink ejection surface 361 can be cleaned with the cleaning liquid 831 containing bubbles, and the ink stuck to the proximity of the ink ejection port 371 can be effectively removed. On the other hand, upon deciding that the ink temperature does not accord with the specified temperature, the controller 100 stands by for the decision that the ink temperature accords with the specified temperature, before starting the control of the cleaning operation. Such an arrangement prevents the cleaning liquid 831 without bubbles from being used to clean the ink ejection surface 361, thereby ensuring that the cleaning liquid 831 containing bubbles is utilized for the cleaning operation.

Figure 13:
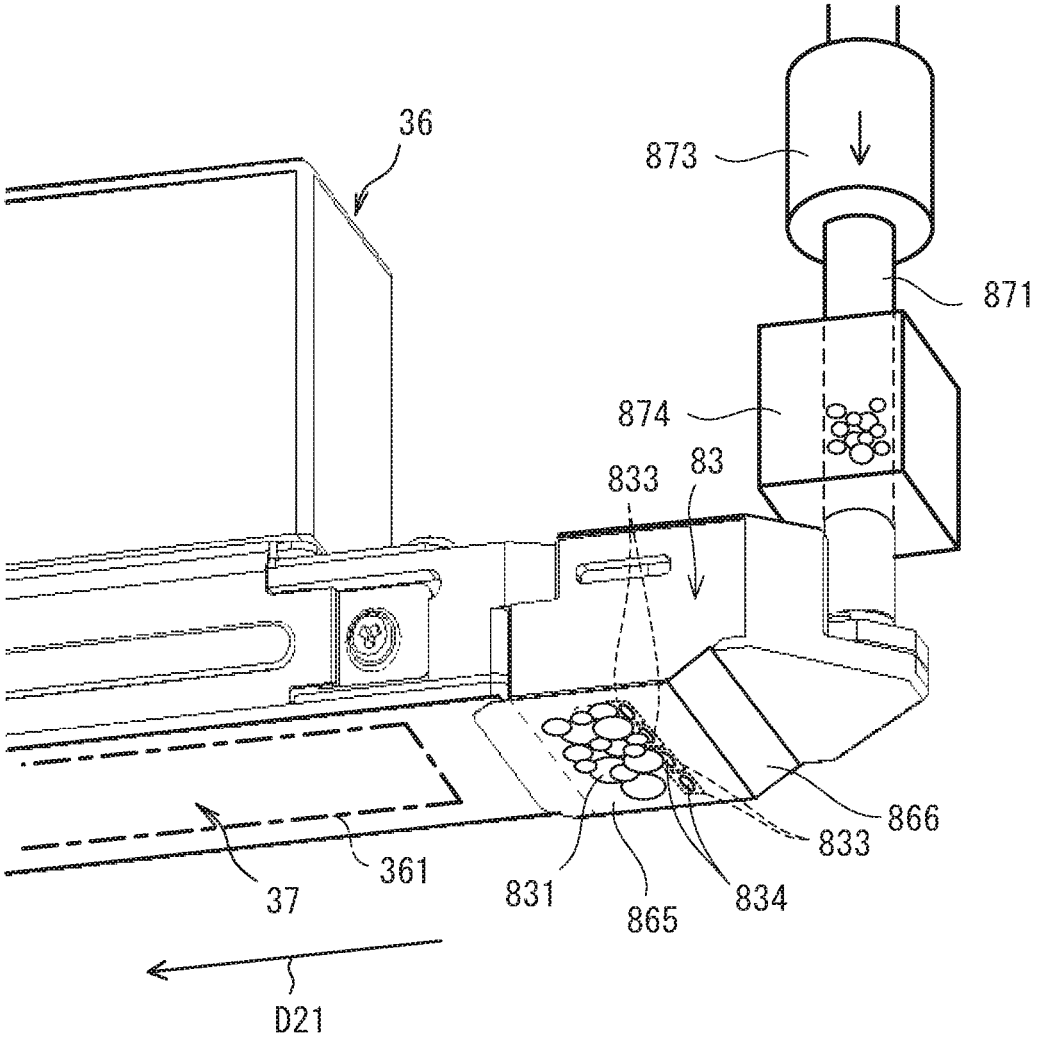
FIG. 13 is a partial perspective view of the portion of the recording head on the side of the cleaning liquid supply device according to a third embodiment, seen from an obliquely lower position.

Hereunder, the ink jet recording apparatus 1 according to a third embodiment will be described. FIG. 13 is a partial perspective view of the portion of the recording head on the side of the cleaning liquid supply device according to the third embodiment, seen from an obliquely lower position.

In the first embodiment, the check valve 873 is provided on the horizontal tubular member 872 (see FIG. 6), to conduct the cleaning liquid 831 toward the cleaning liquid supply device 83. The third embodiment is different from the first embodiment, in that the check valve 873 is located upstream of the heating element 874 attached to the vertical tubular member 871, as shown in FIG. 13.

According to the third embodiment, the check valve 873 is located upstream of the heating element 874 attached to the vertical tubular member 871. In other words, the check valve 873 is located upstream of the position where the cleaning liquid flow path 87 is heated by the heating element 874. Such a configuration prevents the bubbles generated in the vertical tubular member 871 from reaching the horizontal tubular member 872, in other words from reversely flowing.

Although the check valve 873 is only provided on the vertical tubular member 871 in the third embodiment, the check valve 873 may be provided on each of the horizontal tubular member 872 and the vertical tubular member 871.

Figure 14:
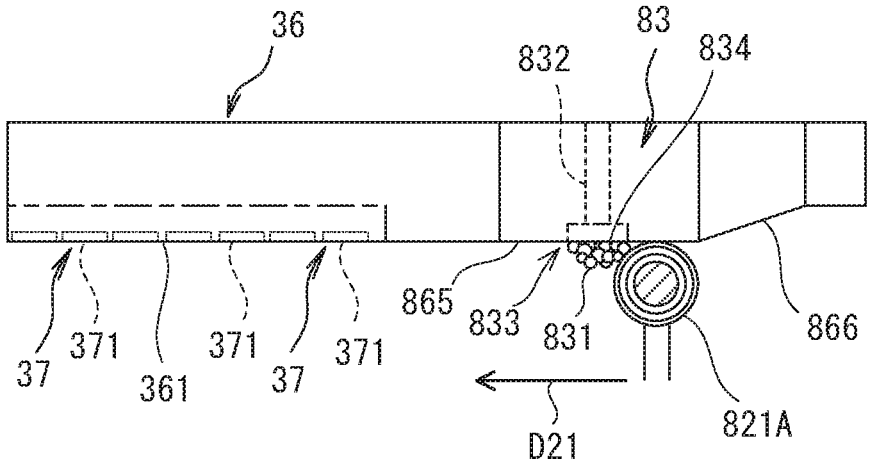
FIG. 14 is a schematic side view of the portion of the recording head on the side of the cleaning liquid supply device, according to a fourth embodiment.

Hereunder, the ink jet recording apparatus 1 according to a fourth embodiment will be described. FIG. 14 is a schematic side view of the portion of the recording head on the side of the cleaning liquid supply device, according to the fourth embodiment.

Although the wiper member 821 according to the first embodiment is formed of a material that is non-absorptive of the cleaning liquid 831, the fourth embodiment is different from the first embodiment in that a wiper member 821A formed of a material absorptive of the cleaning liquid 831 is employed, as shown in FIG. 14.

The wiper member 821A is, for example, formed of an absorptive non-woven cloth, such as a wipe cloth. Here, it suffices that the wiper member 821A includes the absorptive non-woven cloth, at least around an outer portion.

Further, the wiper member 821A may include a rotary shaft oriented in the direction orthogonal to the wiping direction D21 (e.g., transport direction D1 of the recording sheet P shown in FIG. 4B), and the absorptive non-woven cloth may be attached to the outer circumferential surface of the rotary shaft. In this case, the wiper member 821A wipes the ink ejection surface 361 by rotating about the rotary shaft, while moving in the wiping direction D21. Alternatively, the wiper member 821A may be configured to wipe the ink ejection surface 361, without rotating.

Since the wiper member 821A is formed of a material absorptive of the cleaning liquid 831 according to the fourth embodiment, the cleaning liquid 831 containing bubbles is absorbed into the wiper member 821A. Then the cleaning liquid 831 containing bubbles is continuously squeezed out toward the ink ejection surface 361, from inside of the wiper member 821A (i.e., the non-woven cloth in which the cleaning liquid 831 has been absorbed), while the wiper member 821A carrying the cleaning liquid 831 containing bubbles moves in the wiping direction D21 in contact with the ink ejection surface 361. Therefore, the cleaning capability can be maintained during the travel in the wiping direction D21, and resultantly the cleaning performance can be improved.

The disclosure may be modified in various manners, without limitation to the foregoing embodiments. For example, although the MFP is taken up in the foregoing embodiments as an example of the ink jet recording apparatus according to the disclosure, the disclosure is also applicable to various other ink jet recording apparatuses having a printing function.

Further, the configurations and processings described in the foregoing embodiments with reference to FIG. 1 and FIG. 14 are merely exemplary, and in no way intended to limit the disclosure to those configurations and processings.

While the present disclosure has been described in detail with reference to the embodiments thereof, it would be apparent to those skilled in the art the various changes and modifications may be made therein within the scope defined by the appended claims.

What is claimed is:

1. An ink jet recording apparatus comprising:

a recording head including an ink ejection surface having an ink ejection port from which ink is ejected;

a wiper member that wipes the ink ejection surface, by moving in a predetermined wiping direction in contact with the ink ejection surface;

a cleaning liquid supply device including a cleaning liquid supply surface having a cleaning liquid supply port from which cleaning liquid is supplied, and located upstream of the ink ejection surface in the wiping direction;

a cleaning liquid flow path that guides the cleaning liquid to the cleaning liquid supply port;

a pump provides force to the cleaning liquid in the cleaning liquid flow path;

a heating element that is located in contact with an outer circumferential portion of the cleaning liquid flow path; and a control device including a processor, and configured to act, when the processor executes a control program, as a controller that:

causes the heating element to apply heat to the cleaning liquid flow path to generate bubbles in the cleaning liquid in the cleaning liquid flow path;

causes the pump to provide the force to the cleaning liquid in the cleaning liquid flow path to move the cleaning liquid through the cleaning liquid flow path and squeeze out the cleaning liquid containing the bubbles from the cleaning liquid supply port; and moves the wiper member with carrying the cleaning liquid containing the bubbles, in the wiping direction from a movement start position to an end position ahead of the ink ejection surface to contact a gas-liquid interface of the cleaning liquid containing the bubbles with the ink ejection surface.

2. The ink jet recording apparatus according to claim 1, wherein the wiper member is formed of a material non-absorptive of the cleaning liquid.

3. The ink jet recording apparatus according to claim 1, wherein the wiper member is formed of a material absorptive of the cleaning liquid.

4. The ink jet recording apparatus according to claim 1, wherein, to control the cleaning operation, the controller squeezes out purge ink from the ink ejection port of the recording head, and also the cleaning liquid containing bubbles from the cleaning liquid supply port, and moves the wiper member carrying the cleaning liquid containing bubbles in the wiping direction, from the movement start position as far as the end position ahead of the ink ejection surface.

5. The ink jet recording apparatus according to claim 1, further comprising:

a heater that heats the ink on an ink supply path leading to the recording head;

an ink temperature sensor that detects a temperature of the ink heated by the heater; and a storage device in which a degassing state of the cleaning liquid is stored in advance, wherein the cleaning liquid flow path includes a portion located in a range where heat of the heater can reach, and when the storage device indicates that the cleaning liquid has not been degassed, the controller decides whether the ink temperature detected by the ink temperature sensor accords with a printable temperature, performs the control of the cleaning operation upon deciding that the ink temperature accords with the printable temperature, and stands by for the decision that the ink temperature accords with the printable temperature, before starting the control of the cleaning operation, upon deciding that the ink temperature does not accord with the printable temperature.

6. The ink jet recording apparatus according to claim 1, further comprising:

a heater that heats the ink on an ink supply path leading to the recording head;

an ink temperature sensor that detects a temperature of the ink heated by the heater; and a storage device in which a degassing state of the cleaning liquid is stored in advance, wherein the cleaning liquid flow path includes a portion located in a range where heat of the heater can reach, and when the storage device indicates that the cleaning liquid has been degassed, the controller decides whether the ink temperature detected by the ink temperature sensor accords with a specified temperature higher than a printable temperature, performs the control of the cleaning operation upon deciding that the ink temperature accords with the specified temperature, and stands by for the decision that the ink temperature accords with the specified temperature, before starting the control of the cleaning operation, upon deciding that the ink temperature does not accord with the specified temperature.

7. The ink jet recording apparatus according to claim 1, wherein the cleaning liquid supply device further includes an inclined surface continuously extending from the cleaning liquid supply surface toward an upstream side in the wiping direction, and inclined upward with respect to the cleaning liquid supply surface, toward the upstream side in the wiping direction, and the movement start position is set to a predetermined position where a tip portion of the wiper member is located right under the inclined surface, and in an upper region of a plane including the cleaning liquid supply surface.

8. The ink jet recording apparatus according to claim 1, further comprising a scattering prevention member located downstream of the ink ejection surface in the wiping direction, to be contacted by the wiper member after the wiper member has finished to wipe the ink ejection surface, wherein the end position is set to a position where the wiper member contacts the scattering prevention member.

9. The ink jet recording apparatus according to claim 1, wherein the cleaning liquid supply surface has a plurality of cleaning liquid supply ports, the ink jet recording apparatus comprises a plurality of cleaning liquid flow paths corresponding to each of the plurality of cleaning liquid supply ports, and a plurality of heating elements corresponding to each of the plurality of cleaning liquid flow paths, and the one pump is provided in common with the plurality of cleaning liquid flow paths.

* * * * *